US006118224A

United States Patent [19]

Murakami et al.

[11] Patent Number: 6,118,224

[45] Date of Patent: Sep. 12, 2000

[54] DISCHARGE LAMP LIGHTING DEVICE

[75] Inventors: Yoshinobu Murakami; Tokushi Yamauchi, both of Hirakata; Tomoyuki Nakano, Sakai; Toshiya Kanja, Uji, all of Japan

[73] Assignee: Matsushita Electric Works, Ltd., Osaka, Japan

[21] Appl. No.: 09/399,161

[22] Filed: Sep. 20, 1999

[30] Foreign Application Priority Data

Sep. 25, 1998 [JP] Japan ..... 10-270418
Mar. 15, 1999 [JP] Japan ..... 11-069191

[51] Int. Cl.[7] ..... H05B 37/00

[52] U.S. Cl. ..... 315/244; 315/209 R; 315/200 R; 315/171; 315/224

[58] Field of Search ..... 315/209 R, 224, 315/244, 200 R, 246, 171–173, 175, 177; 363/17, 34, 37, 98, 131, 132

[56] References Cited

U.S. PATENT DOCUMENTS 5,063,490 11/1991 Maehara et al. ..... 315/307 X
5,170,099 12/1992 Ueoka et al. ..... 315/291
5,764,496 6/1998 Sato et al. ..... 363/37
5,771,159 6/1998 Sako et al. ..... 363/17
5,914,572 6/1999 Qian et al. ..... 315/307

FOREIGN PATENT DOCUMENTS 5-56647 3/1993 Japan .

*Primary Examiner*—Haissa Philogene
*Attorney, Agent, or Firm*—Burns, Doane, Swecker & Mathis, L.L.P.

[57] ABSTRACT

A discharge lamp lighting device includes an inverter circuit connected through a first impedance element across output ends of a rectifier rectifying an AC source power, a smoothing capacitor inserted through a discharging diode in a power supply path to the inverter circuit, and a series circuit of a second impedance element, discharge lamp and inductor and connected between an output end of the inverter circuit and one output end of the rectifier, wherein a path for charging the smoothing capacitor is formed through a switching element included in the inverter circuit, and the discharging diode.

22 Claims, 16 Drawing Sheets

DISCHARGE LAMP LIGHTING DEVICE

BACKGROUND OF THE INVENTION

This invention relates to a discharge lamp lighting device which provides a high frequency power with such AC power source as commercial power source used as a power source.

DESCRIPTION OF RELATED ART

Conventional discharge lamp lighting device of the kind referred to has been disclosed in, for example, Japanese Patent Laid-Open Publication No. 5-56647, in which a source power of an AC power source Vs is full-wave rectified by a rectifier, an inverter circuit comprising a series circuit of two switching elements is connected across DC output ends of the rectifier, and these switching elements are respectively connected in inverse parallel to a transistor and a diode. Across the DC output ends of the rectifier, further, a circuit of two series connected capacitors is connected, and a parallel circuit of a load and a resonating capacitor is connected through an inductor between a junction point of the two switching elements and a junction point of the series connected capacitors. Further across the DC output ends of the rectifier, a series circuit comprising a smoothing capacitor, charging diode, inductor and switching element is connected, and the smoothing capacitor is charged by a current flowing through this circuit. A charged voltage in this smoothing capacitor is applied through the diode to the series circuit of the two switching elements.

In this case, the respective switching elements are caused to be alternately turned ON and OFF by an optimum control circuit and operate as a half-bridge type inverter with the DC output voltage of the rectifier or the charged voltage in the smoothing capacitor made as a source power, and a high frequency power is supplied to the load. Thus, to this load, the high frequency at the switching frequency of the respective switching elements, and further a voltage occurring across the resonating capacitor due to a resonating action in a series resonance circuit of the resonating capacitor and the inductor is applied to the load. Therefore, the voltage applied to the load can be controlled by controlling the switching frequency. Further, the two capacitors in the series connection are respectively a power source capacitor for dividing a DC input voltage to the inverter and have a capacity set sufficiently larger than the resonating capacitor.

While the foregoing discharge lamp lighting device is advantageous in that required number of parts is relatively small, there has been a problem that, when the diode is made conductive with a regenerative current after turning OFF of one of the switching elements to form a path, for example, of rectifier-smoothing capacitor-diode-load-the other of series connected capacitors-rectifier, and the load is such discharge lamp as a fluorescent lamp having a negative resistance, then there exists no current limiting element with respect to the DC voltage of the rectifier or the smoothing capacitor, so that an excessively large current is caused to flow to the discharge lamp or such unstable operation as a flickering or flicker-off takes place.

In U.S. Pat. No. 5,764,496, for example, there has been suggested measures for improving any input distortion or to restrain such unstable operation as the flickering or the like, but the required number of parts is increased, so as to be a drawback to the dimensional minimization.

SUMMARY OF THE INVENTION

An object of the present invention is to provide a discharge lamp lighting device capable of overcoming the foregoing problems, stably lighting the discharge lamp with input distortion improved, and realizing a cost reduction and dimensional minimization with the required parts number reduced.

According to the present invention, the above object can be realized by means of a discharge lamp lighting device comprising a rectifier for rectifying an AC source power, an inverter circuit including at least a switching element for converting a DC voltage to a high frequency voltage, a smoothing capacitor, a discharging diode inserted in a power supply path from the smoothing capacitor to the inverter circuit for passing a discharge current of the smoothing capacitor, first impedance element inserted in a power supply path from DC output ends of the rectifier to the inverter circuit, a series connection of a load circuit including a resonance circuit and a discharge lamp with second impedance element and inserted between an output end of the inverter circuit and the DC output ends of the rectifier, and a charging diode for allowing its charging current to flow to the smoothing capacitor through a path including the first impedance element, part of the load circuit and switching element of the inverter circuit in ON period of the switching element.

Other objects and advantages of the present invention shall become clear as the description advances as detailed with reference to embodiments of the invention as shown in accompanying drawings.

Figure 1:
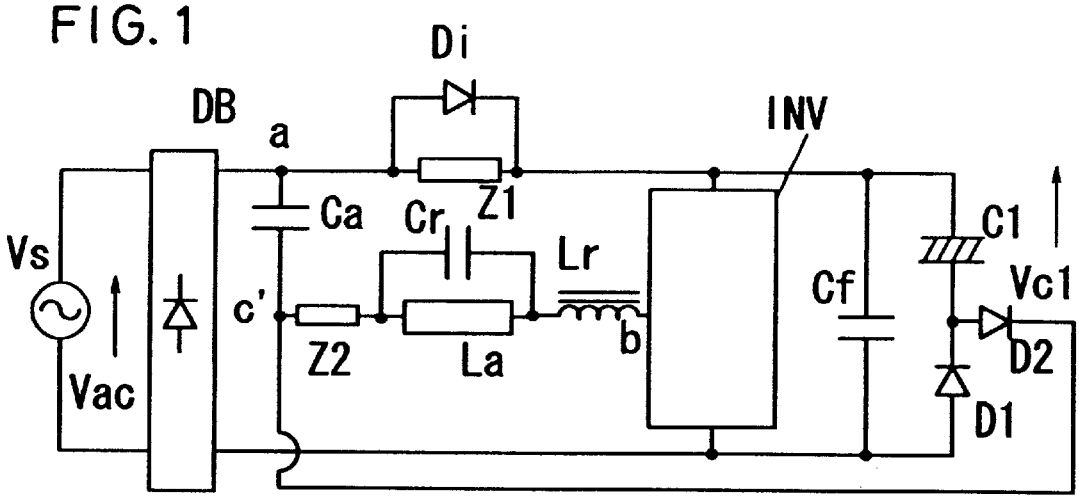
FIG. 1 is a circuit diagram showing a basic circuit 1 of the discharge lamp lighting circuit of the present invention.

While the present invention shall now be described with reference to the embodiments shown in the drawings, it should be appreciated that the intention is not to limit the invention only to these embodiments shown but rather to include all alterations, modifications and equivalent arrangements possible within the scope of appended claims.

DETAILED DESCRIPTION OF THE PREFERRED EMBODIMENTS

Basic Circuit 1

FIG. 1 shows a basic circuit arrangement of respective circuits which will be detailed in the followings as embodiments according to the present invention. In this basic circuit, a source power of AC power source Vs is full-wave rectified by such rectifier DB as a diode bridge, and a series circuit of a smoothing capacitor C1 and a diode D1 is connected through a first impedance element Z1 across DC output ends of the rectifier DB. To this series circuit of the capacitor C1 and diode D1, a by-passing capacitor Cf is connected in parallel. The diode D1 is connected in a polarity for discharging a charge in the capacitor C1. Across this capacitor Cf, an inverter circuit INV is connected, while a series circuit of a discharge lamp La, a second impedance element Z2 and a capacitor Ca is connected, through a resonating inductor Lr, to an output end b of the inverter circuit INV, and the capacitor Ca is connected at an end to a junction point between the rectifier DB and the first impedance element Z1. Further, the second impedance element Z2 comprises at least either a resistor or an inductor so as to allow a DC current across the element.

For the inverter circuit INV, it will be possible to employ one which comprises, for example, a series circuit of a pair of switching elements which are alternately turned ON and OFF, this series circuit of the switching elements is connected in parallel to the by-passing capacitor Cf, and a junction point of the two switching elements is made as the output end b of the inverter circuit INV. To the discharge lamp La, a capacitor Cr which constitutes a resonance circuit together with the resonating inductor Lr is connected in parallel, and a load circuit is formed thereby. To the first impedance element Z1, a diode Di is connected in parallel in a polarity allowing a charging current to flow from the rectifier DB to the smoothing capacitor C1. A junction point c' between the capacitor Ca and the second impedance element Z2 is connected through a diode D2 to a junction point between the smoothing capacitor C1 and the diode D1, while this diode D2 is connected in a polarity allowing a charging current to flow to the capacitor C1, and functions to clamp the potential at the junction point c' of the capacitor Ca and second impedance Z2 to a potential at the junction point of the capacitor C1 and diode D1.

Figure 2:
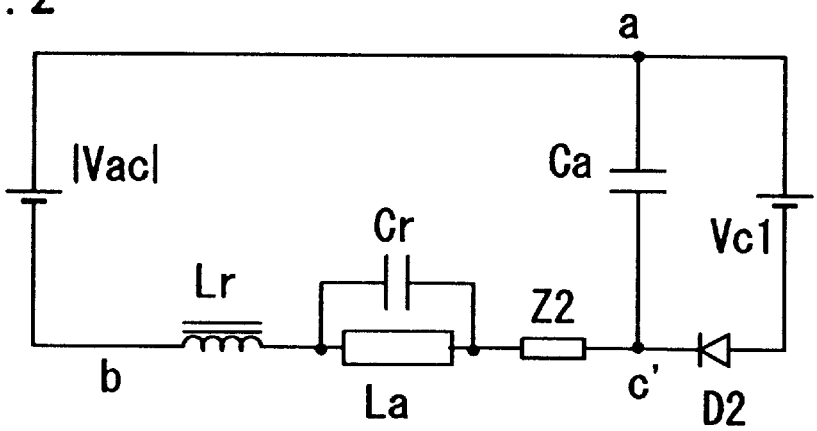
FIG. 2 is an equivalent circuit of FIG. 1.

Next, the operation of the circuit in FIG. 1 shall be described. In a period in which an output voltage of the rectifier DB is higher than a voltage across the smoothing capacitor C1 and a potential at the output end b of the inverter circuit INV is of a potential at negative side electrode of the rectifier DB, the diode D2 is conducted to cause a charge current to flow to the smoothing capacitor C1 through a path of the rectifier DB-capacitor C1-diode D2-inductor Lr-inverter circuit INV-rectifier DB. That is, a voltage across the series circuit of the inductor Lr, discharge lamp La (with the parallel capacitor Cr) and impedance element Z2 will be (an absolute value of voltage Vac of the AC power source Vs)–(a voltage Vc1 across the capacitor C1), so long as a voltage drop at the rectifier DB, diodes Di and D2, inverter circuit INV and so on is ignored. Further, a voltage across the capacitor Ca (across junction points a and c') is clamped at a fixed value substantially equal to the voltage Vc1 across the smoothing capacitor C1. An equivalent circuit in this state will be as shown in FIG. 2. Accordingly, in a period in which the output voltage of the rectifier DB is higher than the voltage across the capacitor C1 and the charge current is flowing to the capacitor C1, a voltage applied to the series circuit of the impedance element Z2, discharge lamp La and inductor Lr drops to be remarkably lower than the output voltage of the rectifier DB.

As a result, so long as the impedance element Z2 employed is one which does not allow any DC current to pass therethrough, the applied voltage to the discharge lamp La becomes lower than the output voltage of the rectifier DB in the period in which the charge current flows to the smoothing capacitor C1, and the impedance so increases as to interrupt the lamp current. With such variation in the impedance, the discharge at the discharge lamp La is caused to be unstable, so as to render a flickering, or flicker-off to takes place. Therefore, with the use of an arrangement which allows the direct current to pass therethrough as the impedance element Z2, it is enabled to keep the current to flow to the discharge lamp La even when the voltage across the capacitor Ca is clamped, and to improve unstable discharge of the discharge lamp La occurring in the period in which the output voltage of the rectifier DB is higher than the voltage across the smoothing capacitor C1 and the charge current is flowing to this capacitor. Here, it will be possible to omit the inductor Lr when an inductor capable of functioning as the inductor Lr is employed as the impedance element Z2.

In a period in which the potential at the output end b of the inverter circuit INV becomes the negative side potential of the rectifier DB, further, a current flows through a path of the rectifier DB-capacitor Ca-impedance element Z2-discharge lamp La (including the capacitor Cr)-inductor Lr-inverter circuit INV-rectifier DB, it is enabled to cause an input current to flow in a high frequency manner from the AC power source Vs by the variation in the potential at the output end b of the inverter circuit INV, the input current can be made to be of a relatively smooth wave form only by providing a small scale filter for blocking high frequencies between the AC power source Vs and the rectifier DB, and any distortion in the input current can be restrained.

First Embodiment

Figure 3:
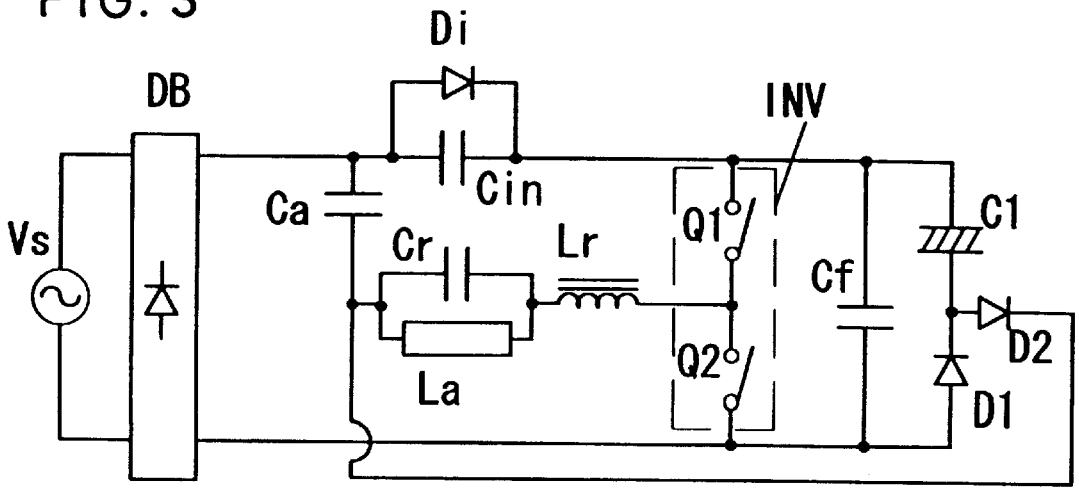
FIG. 3 is a circuit diagram showing first embodiment of the discharge lamp lighting device of the present invention.

First embodiment shown in FIG. 3 is a practical example of basic circuit 1 shown in FIG. 1. That is, the inverter circuit INV is constituted by a series circuit of a pair of switching elements Q1 and Q2, and a capacitor Cin is employed as the first impedance element Z1. For the switching elements Q1 and Q2, ones which can let currents flow bilaterally in their ON state but in backward direction in their OFF state are used. For example, one in which transistors are provided with diodes respectively connected inverse parallel across the collector and emitter for forming current path in OFF state of the diodes, one which comprises MOSFET's and the like may be employed. In the case of MOSFET's, the current path will be that in OFF state of body-diodes formed due to their structure. Further, for the impedance element Z2, the inductor Lr is used in common with the element. Both switching elements Q1 and Q2 are alternately turned ON and OFF by a control circuit not shown. The AC power source Vs is a commercial power source, and the switching elements Q1 and Q2 are set in their ON/OFF frequency to be sufficiently higher than the frequency of the AC power source Vs. Other respects of the arrangement are as has been shown in the basic circuit 1.

This practical circuit operates as shown in FIGS. 4 and 5 in steady state. While in FIGS. 4 and 5, a discharge path for the smoothing capacitor C1 is omitted, such circuit is substantially the same as the discharge path of the bypassing capacitor Cf. FIG. 4 shows the operation in a period in which the output voltage |Vac| of the rectifier DB is higher than the voltage Vc1 across the capacitor C1, and FIG. 5 shows the operation in the period in which the output voltage |Vac| of the rectifier DB is below the voltage Vc1 of the capacitor C1. The operation of FIGS. 4*a*–4*g* and that of FIGS. 5*a*–5*f* are respectively circulatingly repeated. In these drawings, further, any voltage drop at the diodes and switching elements is ignored.

Figure 4A:
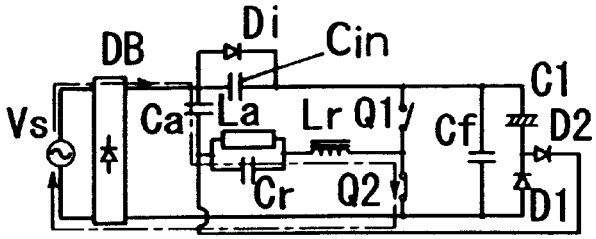
FIGS. 4*a*–4*g* and FIGS. 5*a*–5*f* are exaplanatory diagrams for the operation of the circuit in FIG. 3.
Figure 4B:
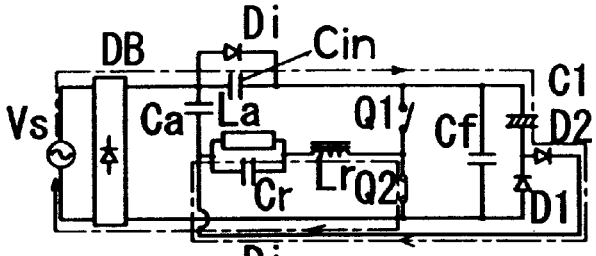
Figure 4C:
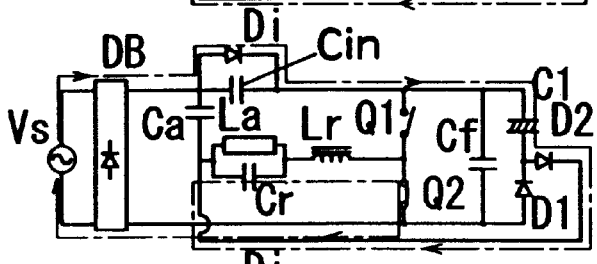

First, references shall be made to the period in which the output voltage |Vac| of the rectifier DB is higher than the voltage Vc1 across the smoothing capacitor C1. Now, when the switching element Q2 is ON as in FIG. 4*a*, a current flows through a path of the rectifier DB-capacitor Ca-discharge lamp La (and capacitor Cr)-inductor Lr-switching element Q2-rectifier DB. After the charge of the capacitor Ca, a current flows through a path, as in FIG. 4*b*, of the rectifier DB-capacitor Cin-capacitor C1-diode D2-discharge lamp La (capacitor Cr)-inductor Lr-switching element Q2-rectifier DB, thereafter, as in FIG. 4*c*, there flows a current through a path of the rectifier DB-diode D1-capacitor C1-diode D2-discharge lamp La (capacitor Cr)-inductor Lr-switching element Q2-rectifier DB. In the state of FIGS. 4*b* and 4*c*, the capacitor C1 is charged, and the voltage across the capacitor Ca reaches the same value as the voltage Vc1 across the smoothing capacitor C1. To the inductor Lr, the DC current flows so that the inductor Lr functions as the impedance element Z2, and the current can be kept supplied to the discharge lamp La. That is, the discharge state of the discharge lamp La never becomes unstable. In this manner, the input current is made to flow from the AC power source Vs in the ON period of the switching element Q2 as in FIGS. 4*a*–4*c*.

Figure 4D:
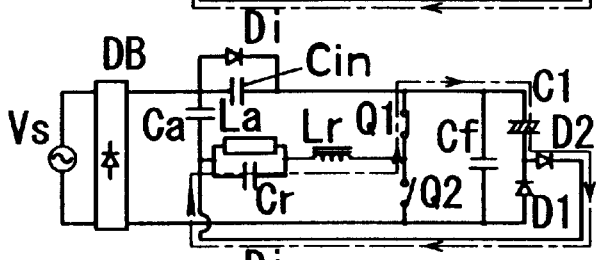
Figure 4E:
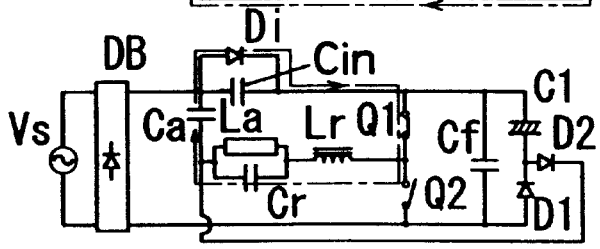

Next, as the switching element Q2 is in OFF state and the switching element Q1 is ON, an accumulated energy in the inductor Lr is discharged, as in FIG. 4*d*, through a path of the inductor Lr-switching element Q1-capacitor C1-diode D2-discharge lamp La (capacitor Cr)-inductor Lr, and, thereafter, a charge in the capacitor Ca is discharged, as in FIG. 4*e*, through a path of the capacitor Ca-diode Di-switching element Q1-inductor Lr-discharge lamp La (capacitor Cr)-capacitor Ca.

Figure 4F:
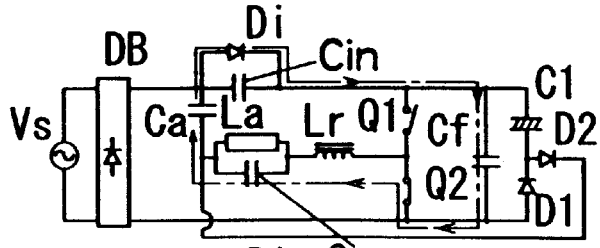
Figure 4G:
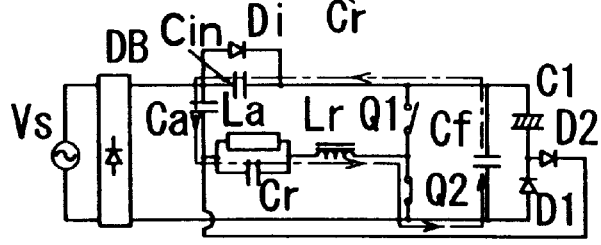

As the switching element Q1 turns OFF and the switching element Q2 is ON this state, the capacitor Ca and inductor Lr will become an electromotive force, so that, as in FIG. 4*f*, there flows a current through a path of the capacitor Ca-diode Di-capacitor Cf-switching element Q2-inductor Lr-discharge lamp La (capacitor Cr)-capacitor Ca, and thereafter the charges in the capacitors Cin and Cf are discharged, as in FIG. 4*g*, through a path of the capacitor Cin-capacitor Ca-discharge lamp La (capacitor Cr)-inductor Lr-switching element Q2-capacitor Cf-capacitor Cin. As the voltage across the series circuit of the capacitors Cin and Cf comes below the output voltage of the rectifier DB, the state of FIG. 4*a* is restored, and the foregoing operation is repeated.

As will be clear from the foregoing description, it is possible to keep the current stably supplied to the discharge lamp La because of the presence of the inductor Lr as in FIGS. 4*a*–4*d*, in the period in which the output voltage |Vac| of the rectifier DB is higher than the voltage Vc1 across the capacitor C1, and it is enable to assure a stable lighting state of the discharge lamp La even while charging the capacitor C1.

Figure 5A:
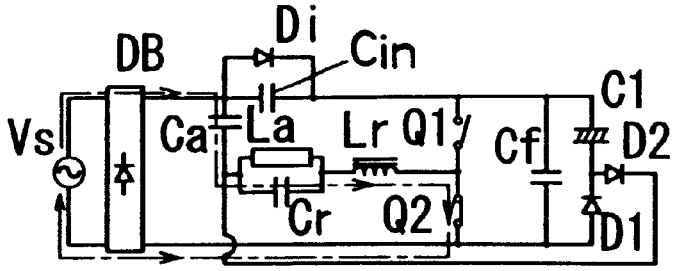

On the other hand, in the period when the output voltage |Vac| of the rectifier DB is lower than the voltage Vc1 across the capacitor C1, there flows a current upon turning ON of the switching element Q2, as in FIG. 5*a*, through a path of the rectifier DB-capacitor Ca-discharge lamp La (capacitor Cr)-inductor Lr-switching element Q2-rectifier DB. In this period, the diode Di is not conducted, and a differential voltage between the output voltage |Vac| of the rectifier DB and the voltage across the capacitor C1 is applied to the capacitor Cin.

Figure 5B:
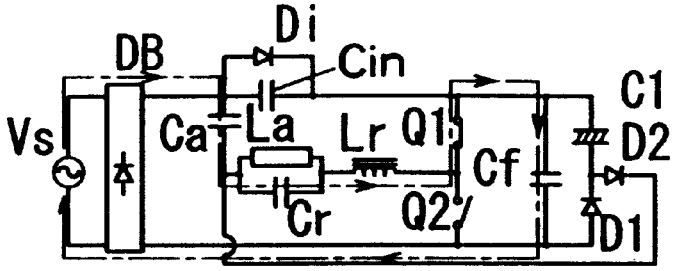
Figure 5C:
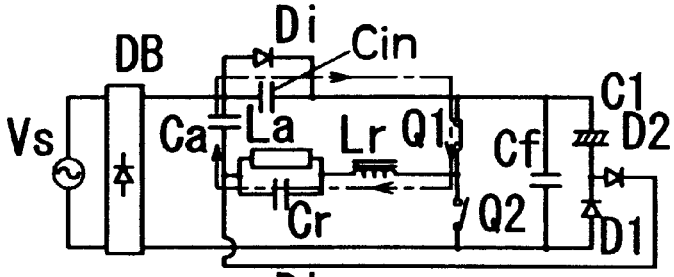
Figure 5D:
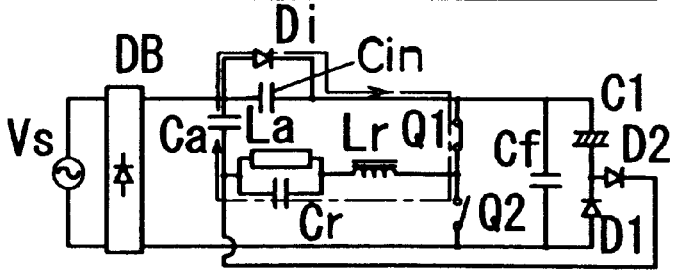

Next, as the switching element Q1 is made ON and the switching element Q2 is OFF as in FIG. 5*b*, a current flows through a path of the rectifier DB-capacitor Ca-discharge lamp La (capacitor Cr)-inductor Lr-switching element Q1-capacitor Cf-rectifier DB. Then, as the capacitor Ca is charged and the energy in the inductor Lr is discharged, there flows a current, as in FIG. 5*c*, through a path of the capacitor Ca-capacitor Cin-switching element Q1-inductor Lr-discharge lamp La (capacitor Cr)-capacitor Ca, and, thereafter, there flows a current, as in FIG. 5*d*, through a path of the capacitor Ca-diode Di-switching element Q1-inductor Lr-discharge lamp La (capacitor Cr)-capacitor Ca.

Figure 5E:
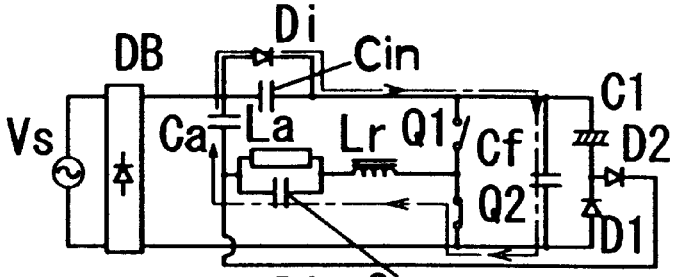
Figure 5F:
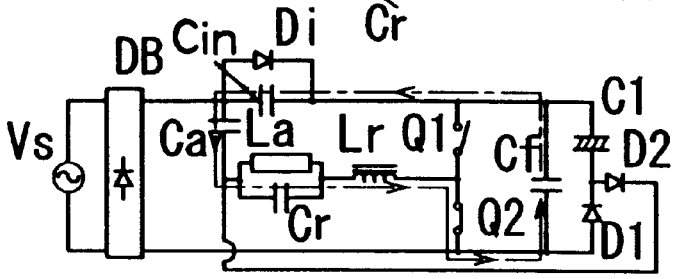

As the switching element Q1 turns OFF and the switching element Q2 is made ON in this state, there flows a current as in FIG. 5*e* through a path of the capacitor Ca-diode Di-capacitor Cf-switching element Q2-inductor Lr-discharge lamp La (capacitor Cr)-capacitor Ca, and, after discharging of the capacitor Ca, the charges in the capacitors Cin and Cf are discharged as in FIG. 5*f* through a path of the capacitor Cin-capacitor Ca-discharge lamp La (capacitor Cr)-inductor Lr-switching element Q2-capacitor Cf-capacitor Cin. As the voltage across a series circuit of the capacitors Cin and Cf is caused to be less than the output voltage of the rectifier DB in this manner, the state of FIG. 5*a* is restored and the foregoing operation is repeated.

As will be clear from the foregoing description, even the period in which the output voltage |Vac| of the rectifier DB is below the voltage Vc1 across the smoothing capacitor C1 includes a period in which the input current flows from the AC power source Vs as in FIGS. 5*a* and 5*b*, whereby it is enabled to render the input current to flow in the manner of the high frequency, and to restrain easily the distortion of the input current. Yet, it is possible to maintain a high power factor since the input current is substantially in proportion to the voltage of the AC power source Vs.

Second Embodiment

Figure 6:
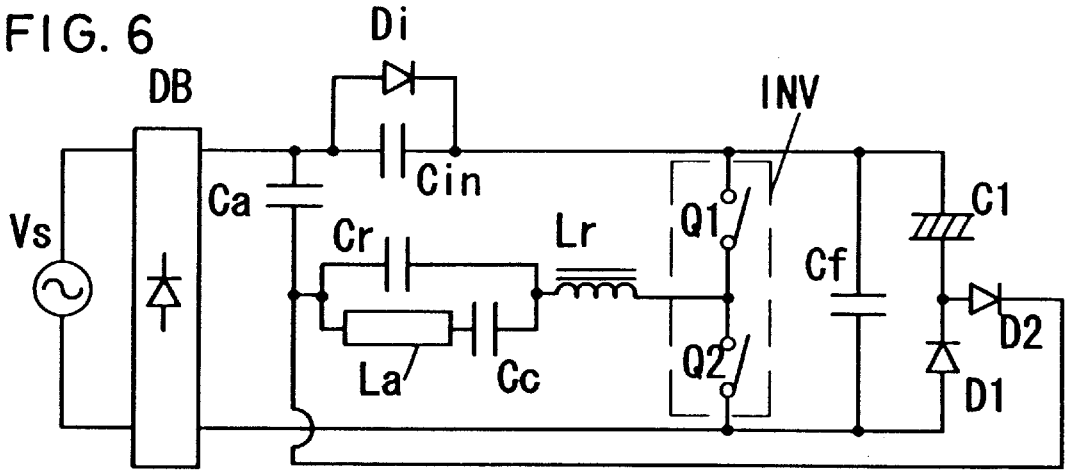
FIG. 6 is a circuit diagram showing second embodiment of the device according to the present invention.

In this embodiment, as shown in FIG. 6, a further capacitor Cc is connected in series to the discharge lamp La in the first embodiment, so that the capacitor Cr will be connected in parallel with a series circuit of the discharge lamp La and capacitor Cc. All remaining respects are the same as in the arrangement of the first embodiment.

In the present embodiment, the capacitor Cc removes any DC component and also removes any DC bias component from the lamp current to the discharge lamp La, and it is possible to prevent such inconvenience as cataphoresis phenomenon from occurring. It is also possible to attain the same function even when the capacitor Cc is connected in series with the inductor Lr and the parallel circuit of the discharge lamp La and capacitor Cr is connected to the series circuit of the capacitor Cc and inductor Lr.

Third Embodiment

Figure 7:
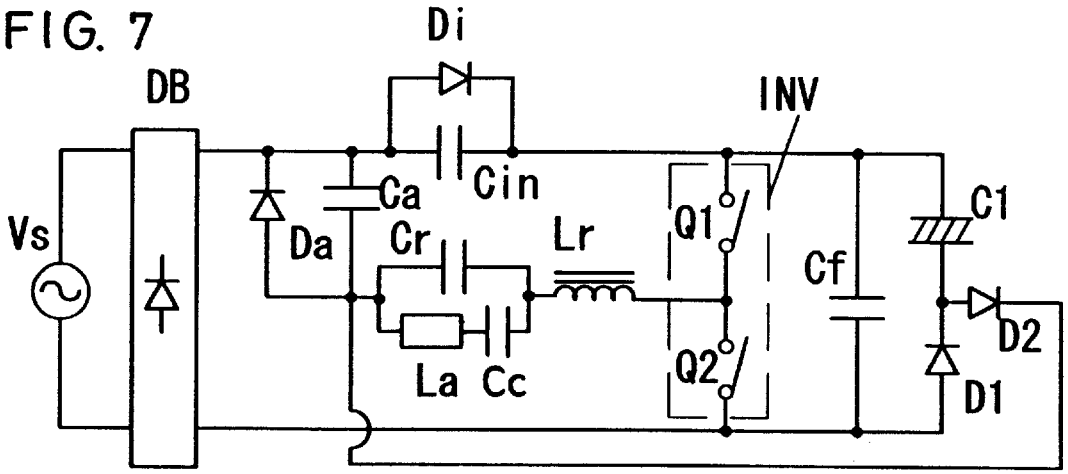
FIG. 7 is a circuit diagram showing third embodiment according to the present invention.

In this embodiment, as shown in FIG. 7, an additional diode Da is connected in parallel with the capacitor Ca in the second embodiment, so that the cathode of the diode Da is connected to the positive side end of the rectifier DB. Therefore, this diode Da functions to limit the voltage amplitude of the capacitor Ca.

More concretely, in the absence of the additional diode Da, there happens that, during the operation of the inverter circuit INV, the potential on the side connected to the diode D2 of the capacitor Ca is higher than that on the side connected to the positive side output end of the rectifier DB. In this event, the charging of the smoothing capacitor C1 is not started until the voltage Vc1 across the capacity C1 and the voltage across the capacitor Ca become equal to each other, after the charge in the capacitor Ca is discharged and the polarity of the voltage across the capacitor Ca is reversed. In the present embodiment, on the other hand, the provision of the diode Da renders the diode Da itself to be conducted when the potential on the diode D2 side of the capacitor Ca, so that the voltage amplitude of the capacitor Ca in this polarity is limited, and consequently the time in which the polarity of the voltage across the capacitor Ca is inverted and the charging of the capacitor C1 is started is to be shortened. That is, the conduction time of the diode D2 is prolonged, and it becomes possible to render the charging period of the capacitor C1 to be longer than that in the second embodiment. In short, it becomes easier to assure a required voltage across the capacitor C1 by charging sufficiently the capacitor C1. Other respects of the arrangement and operation are the same as those in the second embodiment.

Fourth Embodiment

Figure 8:
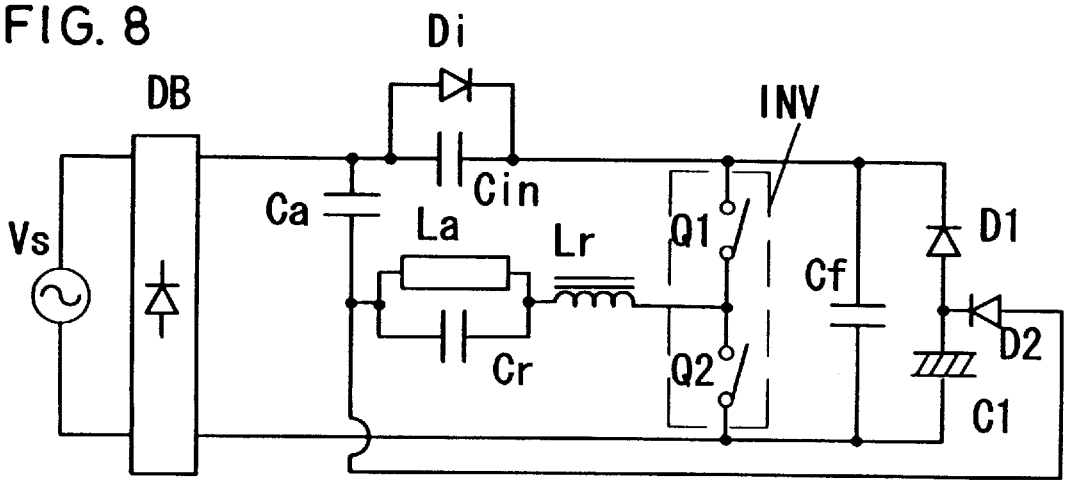
FIG. 8 is a circuit diagram showing fourth embodiment according to the present invention.

In this embodiment, as shown in FIG. 8, respective positions of the diode D1 and capacitor C1 in the first embodiment are exchanged, and connecting polarity of the diode D2 is inverted. Accordingly, while in the first embodiment the capacitor C1 is charged mainly in ON period of the switching element Q2, the capacitor C1 is charged mainly in ON period of the switching element Q1 in the present embodiment. Upon conduction of the diode D2, therefore, a differential voltage between the output voltage |Vac| of the rectifier DB and the voltage Vc1 across the capacitor C1 is applied to the series circuit of the discharge lamp La and inductor Lr. Here, as the current is made to continuously flow to the discharge lamp La by the action of the inductor Lr, the discharge lamp La continues its stable lighting. Other respects of the arrangement and operation are the same as those in the first embodiment. Further, it is also possible to provide the capacitor Cc as in the second embodiment, or to provide the capacitor Cc and diode Da as in the third embodiment.

Fifth Embodiment

Figure 9:
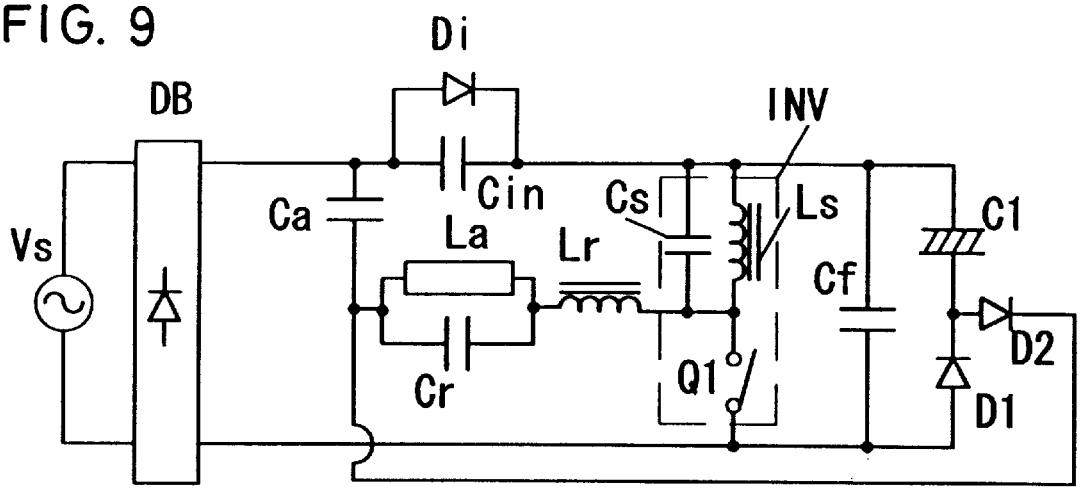
FIG. 9 is a circuit diagram showing fifth embodiment according to the present invention.

In the present embodiment, as shown in FIG. 9, the inverter circuit INV employed here is one comprising a single switching element Q1 and a parallel resonating circuit connected in series with the switching element Q1, while this parallel resonating circuit comprises a parallel circuit of an inductor Ls and a capacitor Cs, and a potential at a junction point between the switching element Q1 and the parallel resonating circuit is made to alternate by the turning ON and OFF of the switching element Q1. That is, a so-called voltage-resonating type, single stone inverter circuit is employed here. Except such formation of the inverter circuit INV, other respects of the arrangement and operation are the same as those in the first embodiment. Also in the present embodiment, the art in the second and third embodiments is utilizable.

Sixth Embodiment

Figure 10:
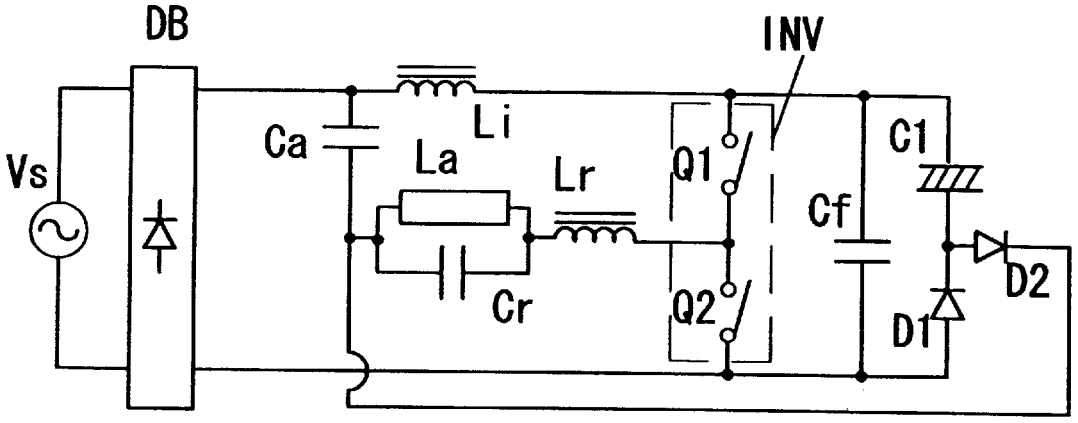
FIG. 10 is a circuit diagram showing sixth embodiment according to the present invention.

In the present embodiment, as shown in FIG. 10, an inductor Li is used in place of the parallel circuit of the capacitor Cin ad diode D1 in the first embodiment. In short, the inductor Li is employed as the impedance element Z1 and, as will be clear from the foregoing description, this impedance element Z1 is effective to restrain the distortion of the input current and also to restrain any deterioration in the power factor.

In the arrangement of the present embodiment, too, similarly to the first embodiment, it is possible to continuously supply the current to the discharge lamp La with the action of the inductor Lr upon charging the capacitor C1 with the diode D2 conducted, and the stable lighting state of the discharge lamp La can be maintained. As the present embodiment is provided with the inductor Li, the continuous supply of the current to the discharge lamp La is also enabled by this inductor Li, and the stable discharge lamp lighting is possible. Other respects of the arrangement and operation are the same as those in the first embodiment, and it is also possible to apply the arrangement of the second or third embodiment to the present embodiment.

Seventh Embodiment

Figure 11:
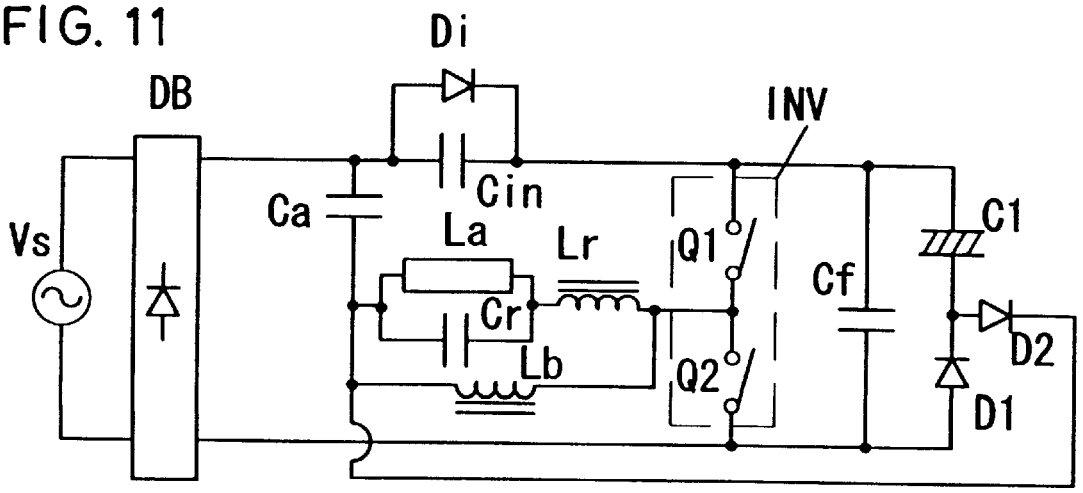
FIG. 11 is a circuit diagram showing seventh embodiment according to the present invention.

In the present embodiment, as shown in FIG. 11, an inductor Lb is added as connected in parallel with the series circuit of the discharge lamp La and inductor Lr in the first embodiment of FIG. 6. With this arrangement, a path through the inductor Lb is to be formed in addition to the path through the inductor Lr, and it is made easier to assure the charging current to the capacitor C1. Yet, with the inductor Lb adjusted, the charging current to the capacitor C1 can be optionally and easily adjusted. Other respects of the arrangment and operation are the same as those in the first embodiment. Further, it is also possible to apply the arrangement of the second or third embodiment to the present embodiment.

Eighth Embodiment

Figure 12:
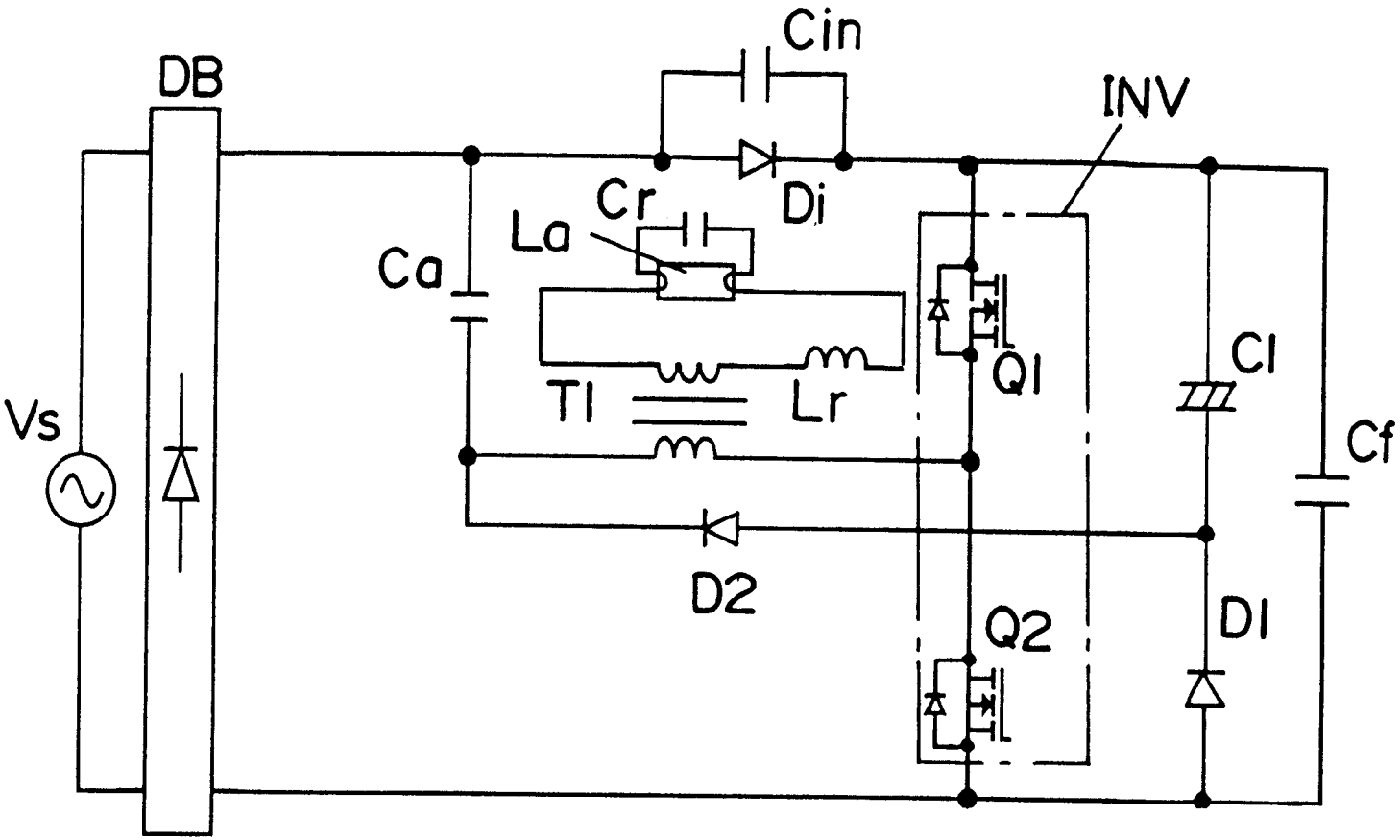
FIG. 12 is a circuit diagram showing eighth embodiment according to the present invention.

In the present embodiment, as shown in FIG. 12, a primary winding of a transformer T1 is inserted between the inverter circuit INV and the capacitor Ca, while a secondary winding of this transformer T1 is connected through the inductor Lr to the discharge lamp La, in place of the series circuit of the discharge lamp La and inductor Lr. Also, the capacitor Cr is connected across non-power-source side ends of both filaments of the discharge lamp La. While this arrangement of the present embodiment is not fully in conformity to that of the basic circuit shown in FIG. 1, the inductor Lr is to function as the second impedance element Z2. In this present embodiment, the switching elements Q1 and Q2 alternately turned ON and OFF are to operate as a half-bridge type inverter circuit.

Next, the operation shall be described in the followings, in which the description shall be made, as divided, to the period in which the charging current can be supplied to the capacitor C1, and to the period in which the capacitor C1 discharges its accumulated energy.

The charging current to the capacitor C1 can be supplied in the period in which the output voltage of the rectifier DB is higher than the voltage across the capacitor C1, which period is adjacent to the peak of the voltage of the AC power source Vs. The operation during this period is as shown in FIGS. 13*a*–13*f*, the operation being in the stationary state. That is, when the voltage across the capacitor Cin reaches the differential voltage between the output voltage |Vac| of the rectifier DB and the voltage across the capacitor Cf while the switching element Q2 is ON as in FIG. 13*a*, there flows a current through a path of the rectifier DB-capacitor Ca-primary winding of transformer T1-switching element Q2-rectifier DB. As the switching element Q2 turns OFF, as in FIG. 13*b*, the current flows through a path of the rectifier DB-capacitor Ca-primary winding of transformer T1-switching element Q1-capacitor Cf-rectifier DB, and, as in FIG. 13*c*, a regenerative current flows through a path of the transformer T1-switching element Q1 capacitor C1-diode D2-transformer T1. In this manner, the input current flows from the AC power source Vs in the period of FIGS. 13*a* and 13*b*, and the capacitor C1 is charged with the regenerative current of accumulated energy in the transformer T1.

Figure 13A:
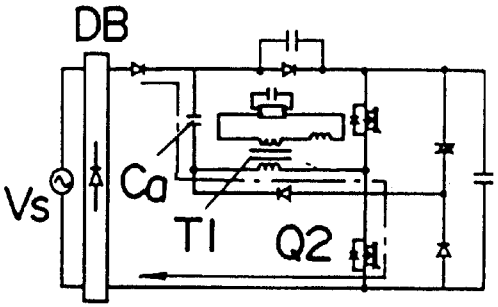
FIGS. 13*a*–13*f* and FIGS. 14*a*–14*f* are explanatory diagrams for the operation of the circuit in FIG. 12.
Figure 13B:
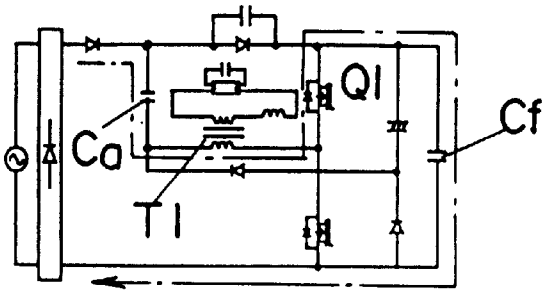
Figure 13C:
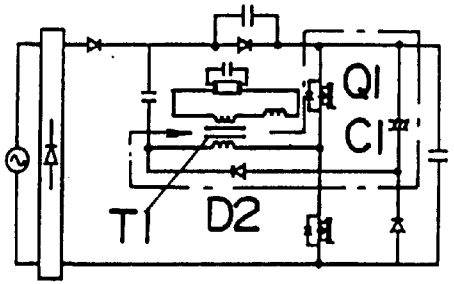
Figure 13D:
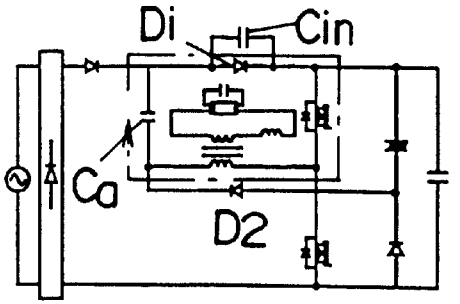

When the switching element Q1 is ON, as in FIG. 13*d*, the charge in the capacitor Ca is discharged through a path of the capacitor Ca-diode Di (capacitor Cin)-switching element Q1-primary winding of transformer T1-capacitor Ca.

Figure 13E:
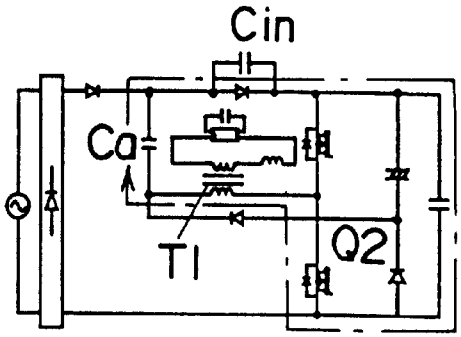
Figure 13F:
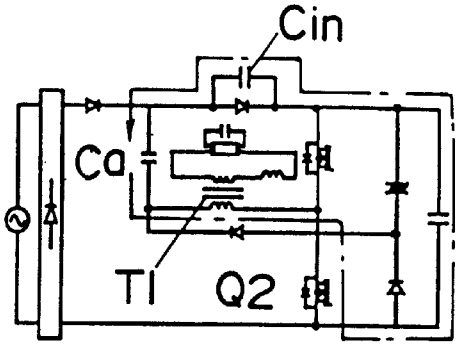

As ths switching element Q1 turns OFF in this state, the capacitor Ca and inductor Lr are made to be the electromotive force, a current flows, as in FIG. 13*e*, through a path of the capacitor Ca-diode Di (capacitor Cin)-capacitor Cf-switching element Q2-primary winding of transformer T1-capacitor Ca, and, as the switching element Q2 turns ON, as in FIG. 13*f*, the charges in the capacitors Cin and Cf are discharged through a path of the capacitor Cin-capacitor Ca-primary winding of transformer T1-switching element Q2-capacitor Cf-capacitor Cin. As the voltage across the capacitor Cin reaches in this manner the differential voltage between the output voltage |Vac| of the rectifier DB and the voltage across the capacitor Cf, the state of FIG. 13*a* is restored and the above operation is repeated.

As will be clear from the foregoing description, it is enabled to continuously supply the current to the discharge lamp La with the presence of the transformer T1 in the period in which the output voltage |Vac| of the rectifier DB is higher than the voltage Vc1 across the capacitor C1, and it is possible to assure the stable lighting state of the discharge lamp La while charging the capacitor C1.

In the period in which the output voltage |Vac| of the rectifier DB is below the voltage Vc1 across the capacitor C1, on the other hand, there flows a current through a path of the rectifier DB-capacitor Ca-primary winding of transformer T1-switching element Q2-rectifier DB when, as in FIG. 14*a*, the switching element Q2 is ON and the voltage across the capacitor Cin reaches the differential voltage between the output voltage |Vac| of the rectifier DB and the voltage across the capacitor Cf.

Figure 14D:
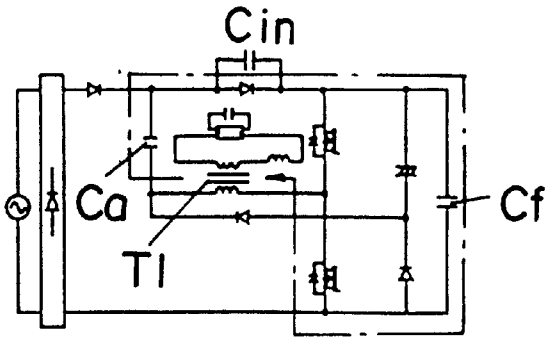
Figure 14E:
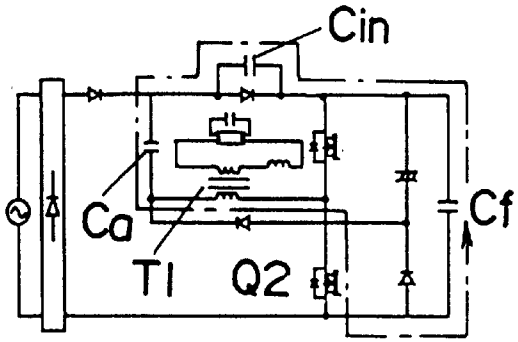
Figure 14F:
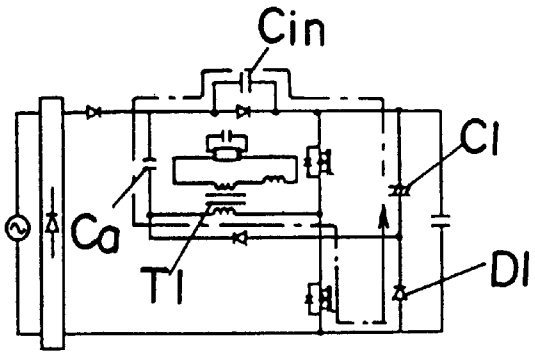
Figure 14A:
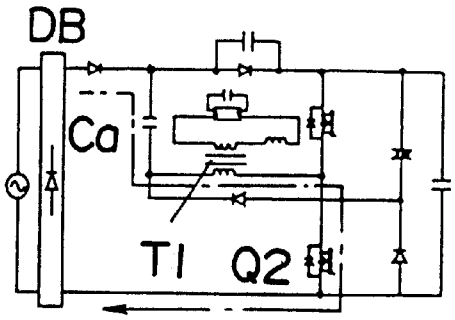
Figure 14B:
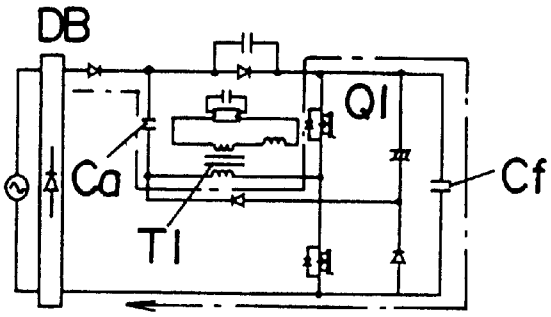
Figure 14C:
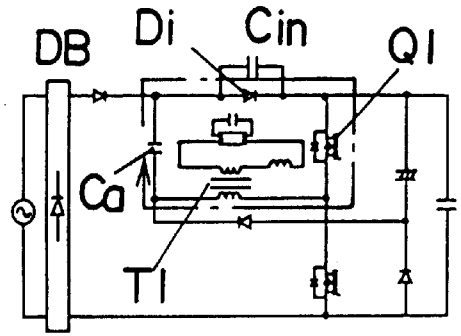

As the switching element Q2 turns OFF, next, the current flows, as in FIG. 14*b*, through a path of the rectifier DB capacitor Ca-primary winding of transformer T1-switching element Q1-capacitor Cf-rectifier DB. That is, it is enabled to cause the input current to flow from the AC power source Vs in the state of FIGS. 14*a* and 14*b*. As in this manner the capacitor Ca is charged and the energy in the inductor Lr is discharged, there flows a current, as in FIG. 14*c*, through a path of the capacitor Ca-diode Di (capacitor Cin)-switching element Q1-primary winding of transformer T1-capacitor Ca.

When in this state the switching element Q1 is made OFF, the regenerative current of the transformer T1 flows, as in FIG. 14*d*, through a path of the transformer T1-capacitor Ca-diode (capacitor Cin)-capacitor Cf-switching element Q2-transformer T1. Thereafter, as in FIG. 14*d*, the charges in the capacitors Cin and Cf are discharged through a path of the capacitor Cf-capacitor Cin-capacitor Ca-primary winding of transformer T1-switching element Q2-capacitor Cf, and, as the voltage across the capacitor Cf is further lowered, a current flows, as in FIG. 14*e*, through a path of the capacitor C1-capacitor Cin-capacitor Ca-primary winding of transformer T1-switching element Q2-capacitor C1. When thus the voltage across the capacitor Cin exceeds the differential voltage between the output voltage |Vac| of the rectifier DB and the voltage across the capacitor Cf, the state of FIG. 14*a* is restored and the foregoing operation is repeated.

As will be clear from the foregoing description, the capacitor Cin repeats its charging and discharging in response to the ON/OFF operation of the switching elements Q1 and Q2, so that the input current can be made to flow from the AC power source Vs in the manner of high frequency, irrespective of the magnitude of the output voltage of the rectifier DB, and the input distortion can be restrained only by providing a small filter for blocking the high frequency as disposed between the AC power source Vs and the rectifier DB. Further, as has been described, the charging current is to flow to the smoothing capacitor C1 in the period in which the output voltage |Vac| of the rectifier DB is relatively high while the discharging current is to flow from the capacitor C1 in the period in which the voltage is relatively low, so that it is enabled to cause the current to flow to the discharge lamp La even in the period in which the output voltage |Vac| of the rectifier DB is relatively low, and any variability in the luminous output of the discharge lamp due to the variability in the voltage within one cycle of the AC power source Vs can be restrained.

Now, in the arrangement where, as in the present embodiment, the transformer T1 to the secondary side of which the discharge lamp La, resonating capacitor Cr and resonating inductor Lr are connected is employed, it is possible that a current equal to a multiple by a turn ratio of the load current on the secondary side flows on the primary side of the transformer T1, the charging current to the smoothing capacitor C1 is caused to be increased. Accordingly, it is enabled to cause a sufficient charging current to flow to the capacitor C1, and to restrain any drop in the voltage across the capacitor C1. This will entail in an increase in the period in which the input current flows, and eventually to the restrain of the distortion of the input current. When the charging current to the capacitor C1 increases, it is also possible to correspondingly increase the output power.

Further, in similar manner to other embodiments, the voltage is applied to the discharge lamp La thorugh the resonating inductor Lr upon conduction of the diode D2, so that the applied voltage to the discharge lamp La will never be unstable, the discharge lamp La can be prevented from flickering or flickering off, and a stable lighting state of the discharge lamp can be maintained.

Figure 15:
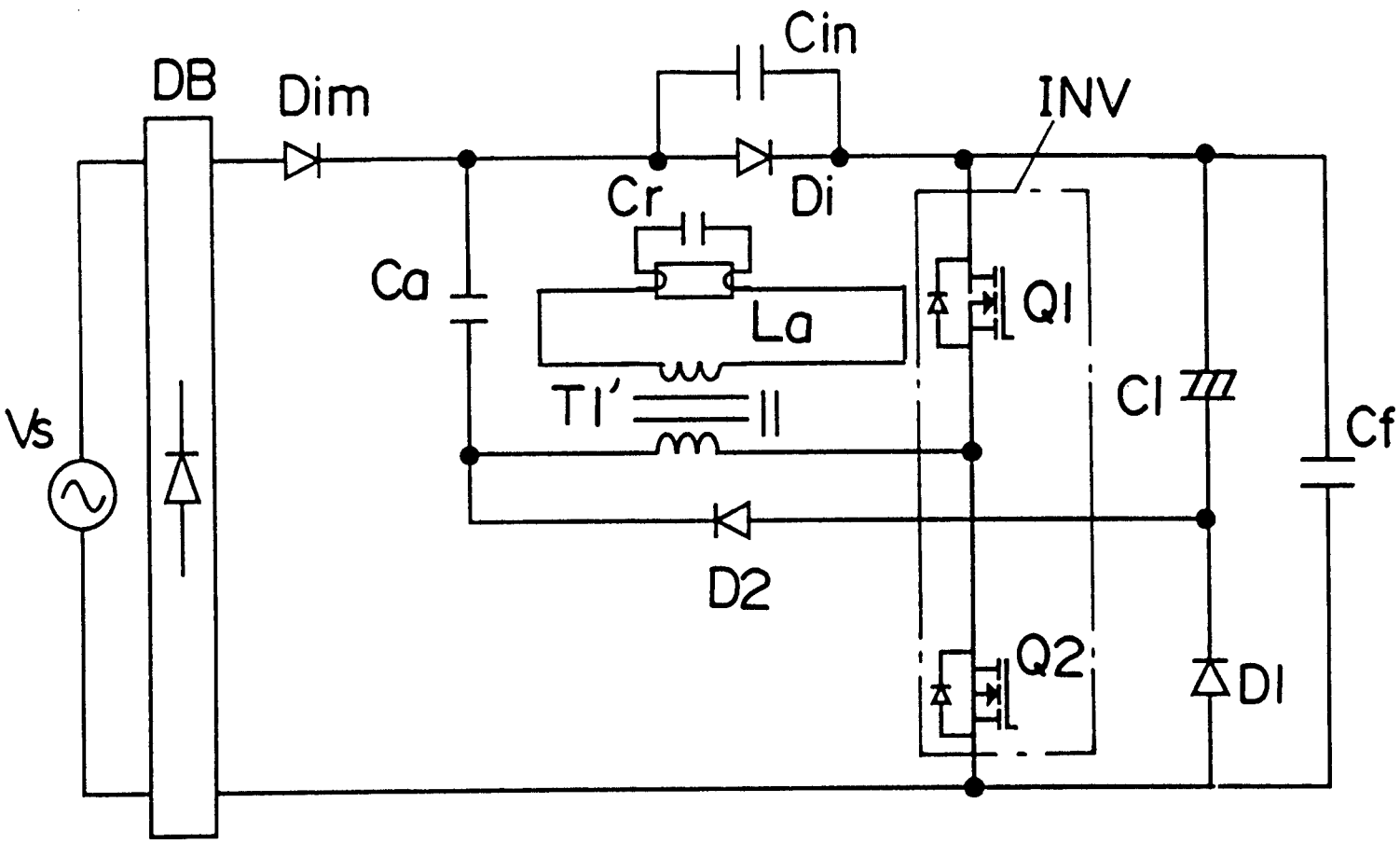
FIG. 15 is a circuit diagram showing a modification of the circuit in FIG. 12.

In an event where, in the present embodiment, a leakage transformer T1' is employed as the transformer T1 as in FIG. 15, the inductor Lr can be replaced by a leakage inductance of such leakage transformer and the inductor Lr is no more required. In the arrangement shown in FIG. 15, further, the capacitor Ca and diode Di are connected respectively through a diode Dim to the positive side of the DC output ends of the rectifier DB. With this arrangement employed, the required number of parts can be reduced. Other respects of the arrangement and operation are the same as those in the first embodiment.

Ninth Embodiment

Figure 16:
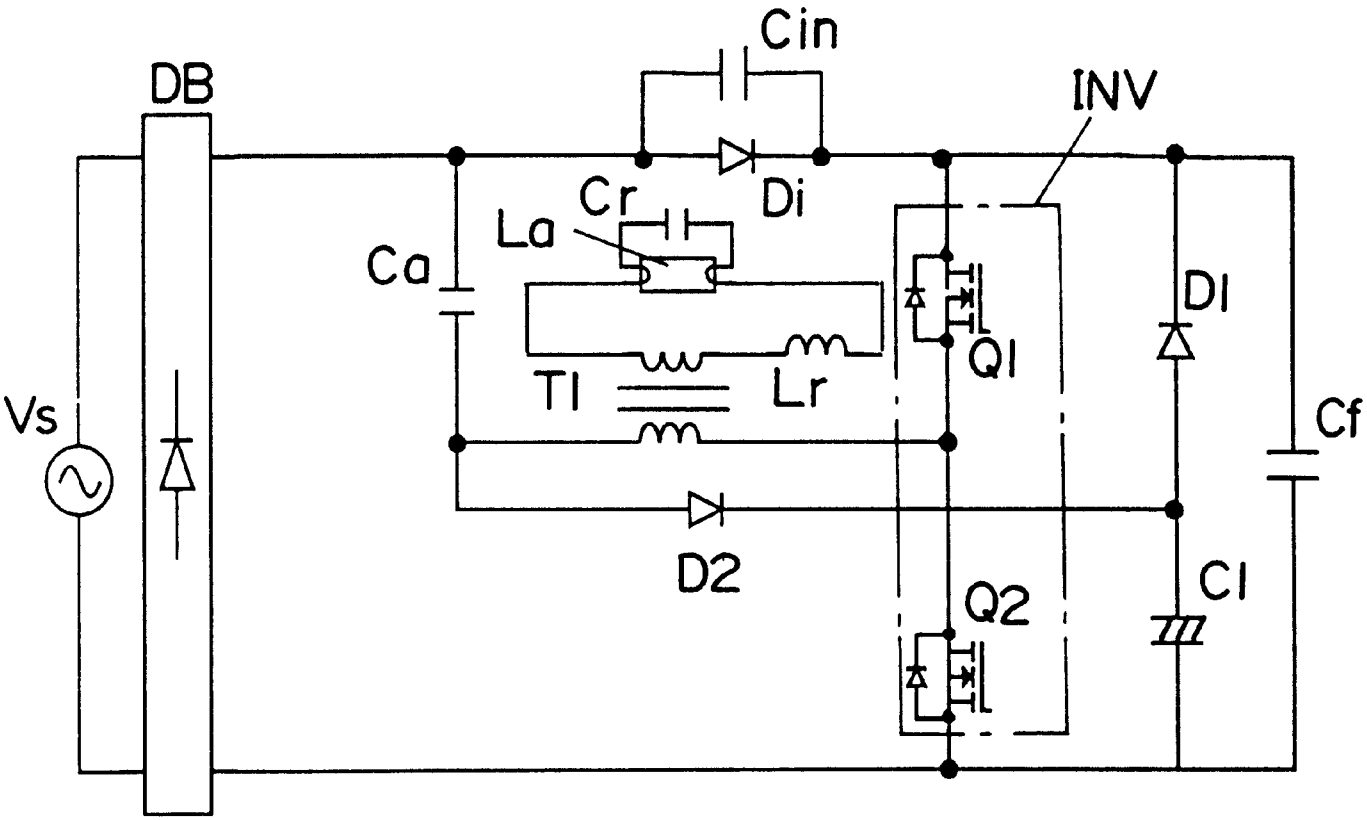
FIG. 16 is a circuit diagram showing ninth embodiment according to the present invention.

In this embodiment, as shown in FIG. 16, the smoothing capacitor C1 and diode D1 are exchanged in their position and the polarity of the diode D2 is inverted in contrast to the eighth embodiment, in the similar relationship of the fourth embodiment to the first embodiment. Therefore, the only difference resides in that the charging current to the smoothing capacitor C1 flows not through the switching element Q1 but through the switching element Q2, and other repsects of the arrangement and operation are the same as those in the eighth embodiment.

Tenth Embodiment

Figure 17:
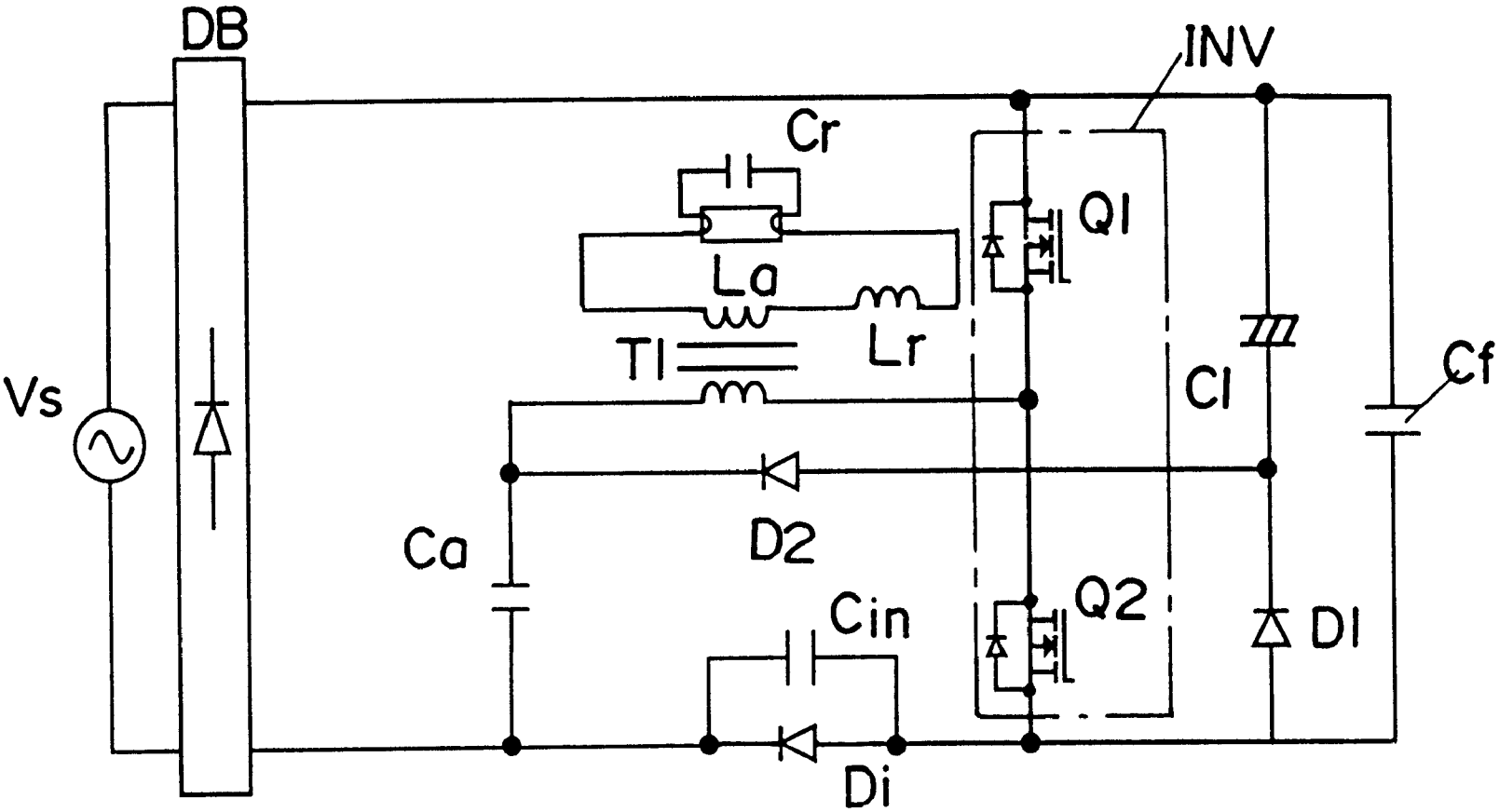
FIG. 17 is a circuit diagram showing tenth embodiment according to the present invention.

This embodiment is a modification of the eighth embodiment, as shown in FIG. 17, in which one end of the capacitor Ca which is connected to the positive side of the DC output ends of the rectifier DB in the eighth embodiment is connected in the present embodiment to the negative side of the DC output ends of the rectifier DB. Further, instead of insertion of the parallel circuit of the capacitor Cin and diode Di between the capacitor Ca and the switching element Q1, the parallel circuit is inserted between the capacitor Ca and the switching element Q2. The diode Di is connected at the anode to the switching element Q2. Other respects of the arrangement and operation are the same as those in the eighth embodiment.

Eleventh Embodiment

Figure 18:
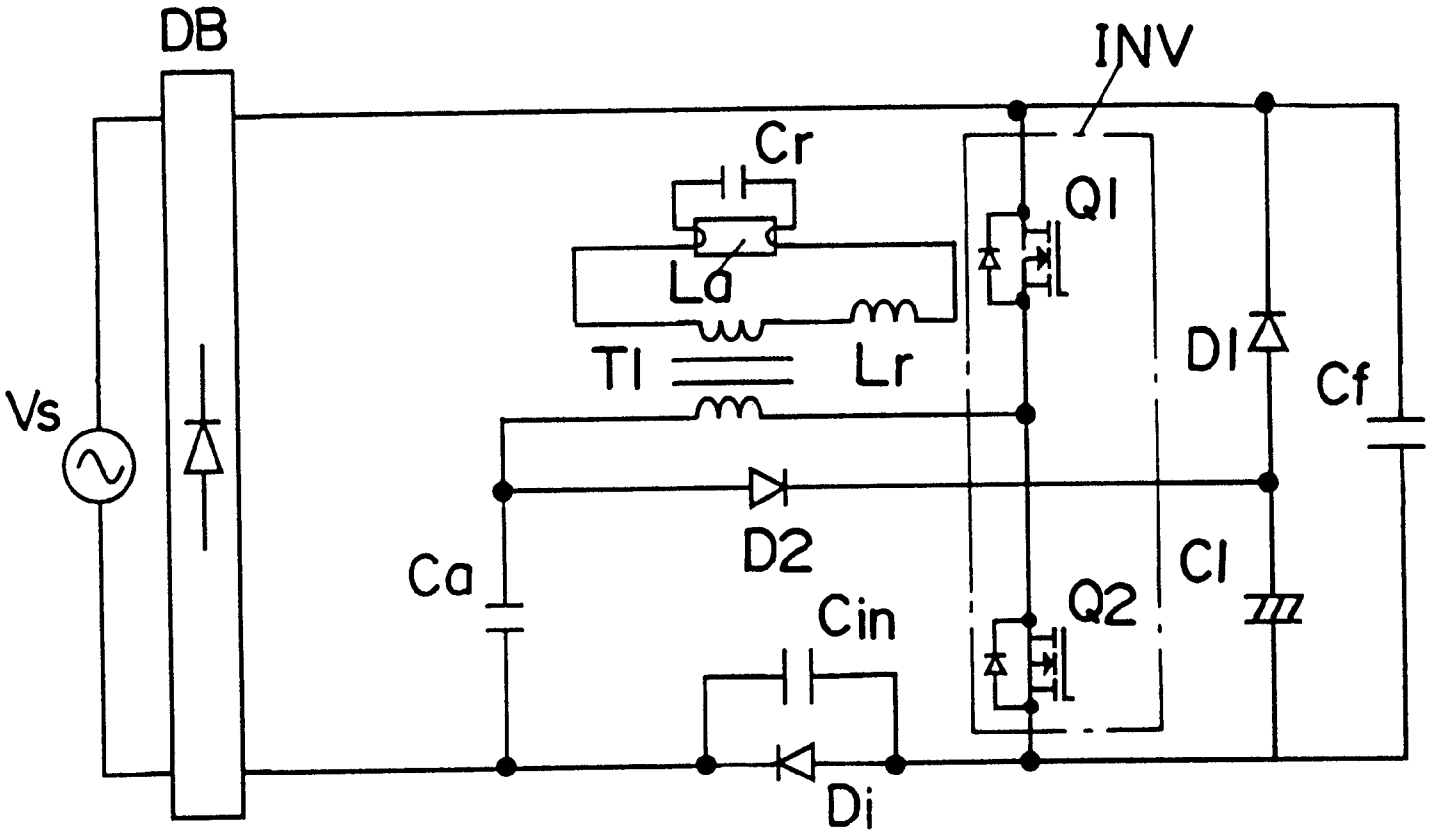
FIG. 18 is a circuit diagram showing eleventh embodiment according to the present invention.

This embodiment is a modification of the eighth embodiment, as shown in FIG. 18, in which the capacitor C1 and dioe D1 are exchanged in their position and the polarity of the diode D2 is inverted in contrast to the tenth embodiment. Therefore, the only difference resides in that the charging current to the capacitor C1 flows not thorugh switching element Q1 but through the switching element Q2, and other respects of the arrangement and operation are the same as those in the tenth embodiment.

Twelfth Embodiment

Figure 19:
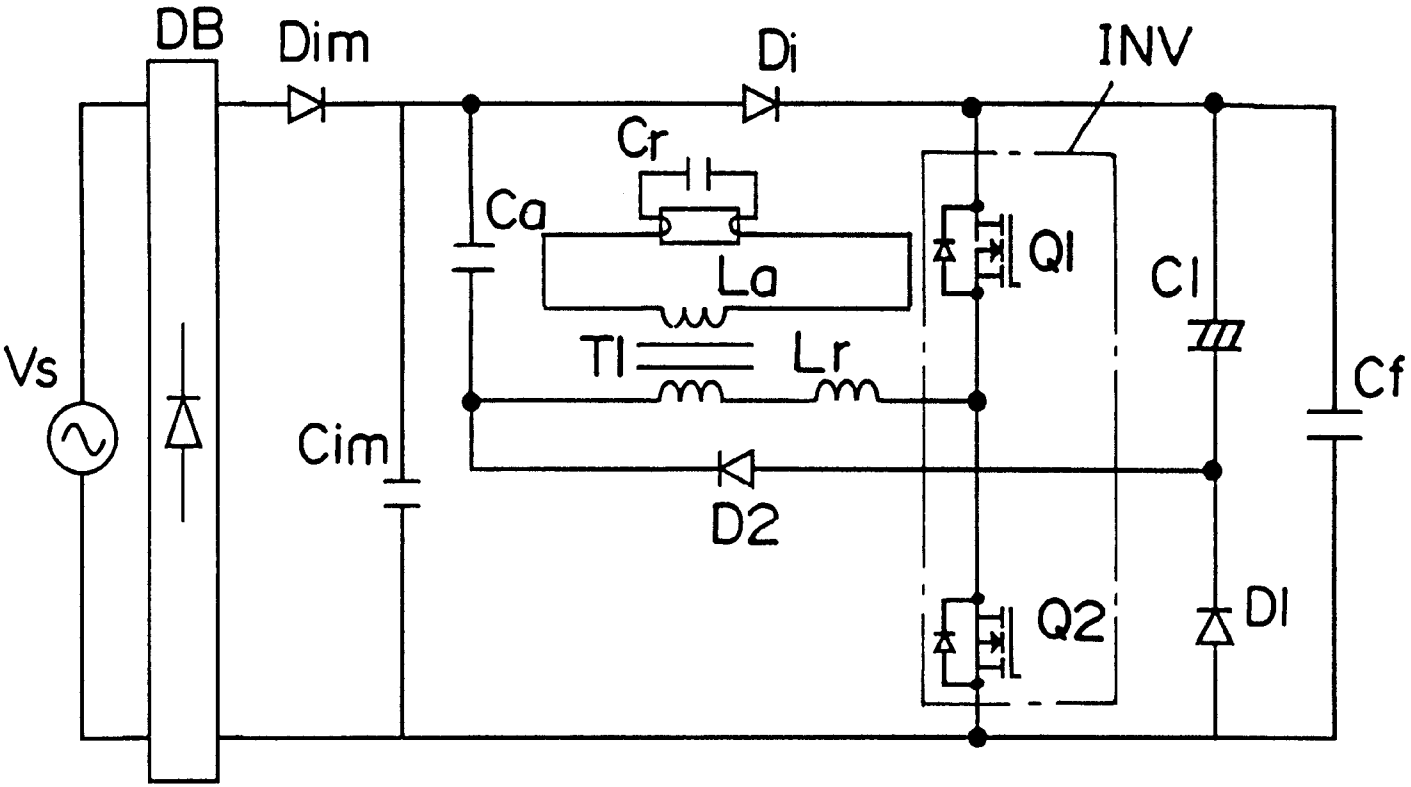
FIG. 19 is a circuit diagram showing twelfth embodiment according to the present invention.

In this embodiment, as shown in FIG. 19, the inductor Lr is connected in series not with the secondary winding but with the primary winding of the transformer T1, and the capacitor Cin is omitted, while a diode Dim and capacitor Cim are addded, in contrast to the eighth embodiment. The diode Dim is inserted between the positive side of the DC output ends of the rectifier DB and a junction point of the capacitor Ca and the diode Di, while the capacitor Cim is connected in series with the diode Dim and this series circuit of the capacitor Cim and diode Dim is connected across the DC output ends of the rectifier DB.

In this arrangement, the capacitor Cim functions to cause the input current from the AC power source Vs to flow in the high frequency manner as the capacitor Cin does, and there is a slight difference from the eighth embodiment in that the input current is made to flow from the AC power source Vs after the discharging of the charge in the capacitor Cim through a path including the primary winding of the transformer T1, while the basic operation is the same as the eighth embodiment. Even with the use of this circuit arrangement, the discharge lamp La can be prevented from flickering or flickering off.

Figure 20:
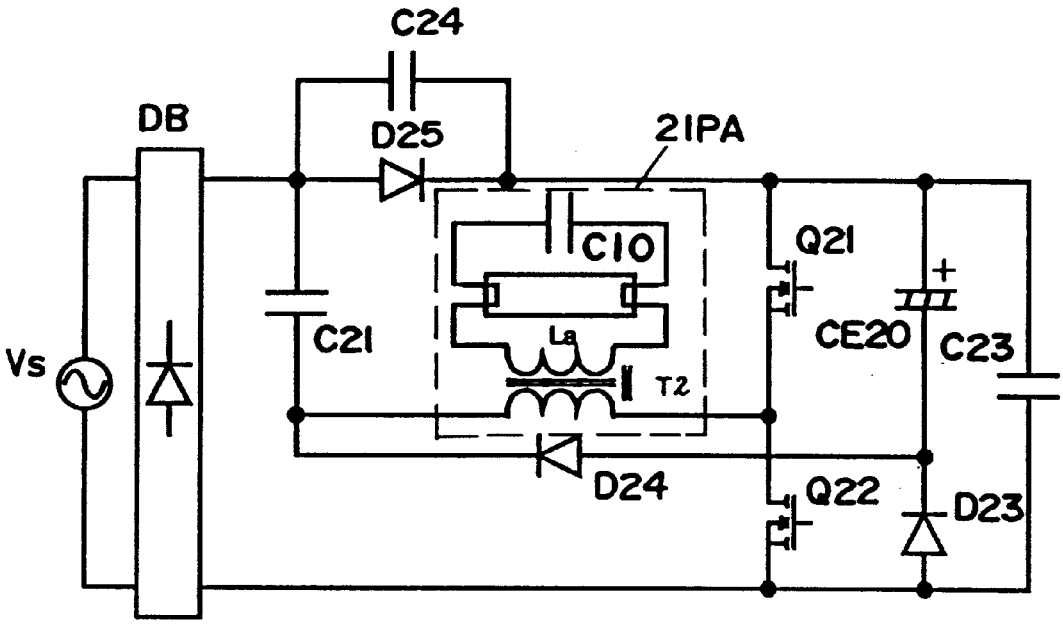
FIG. 20 and FIGS. 21*a*–21*c* are explanatory views for the discharge lamp lighting device.
Figure 21A:
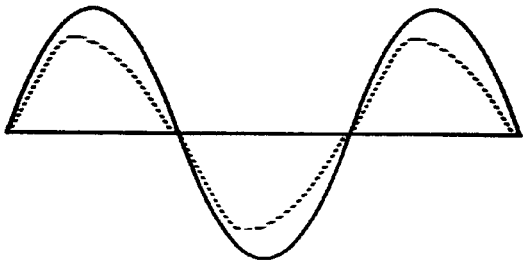
Figure 21B:
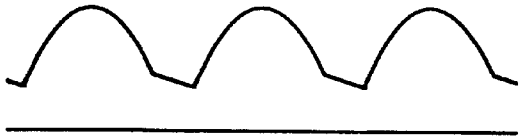
Figure 21C:
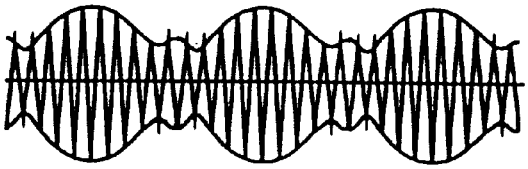

In the discharge lamp lighting device, on the other hand, as shown in FIG. 20, an LC resonance circuit is constituted by a leakage inductance of a leakage transformer T2 and a capacitor C10, and in this case the use of the primary winding of the transformer T2 is determined by a saturation design or the like for attaining the leakage inductance and starting voltage, in order to apply to the discharge lamp La a sufficient voltage for the starting with a resonating operation of the LC resonance circuit. While this results in a supply of an input voltage of a wave form (as shown by a solid line in FIG. 21*a*), and an input current of a wave form (as shown by a broken line in FIG. 21*a*) from the AC power source Vs, it is impossible to attain a properly smooth voltage at valley portions of the voltage (as shown in FIG. 21*b*) applied across the inverter, and it is no more possible to supply any proper output current to the discharge lamp La. That is, such high frequency current of a low crest factor as shown in FIG. 21*c* is caused to flow to the discharge lamp La.

In the followings, it is attempted to provide a power source device capable of rendering both of the input current distortion and the crest factor of output current to be proper.

Thirteenth Embodiment

Figure 22:
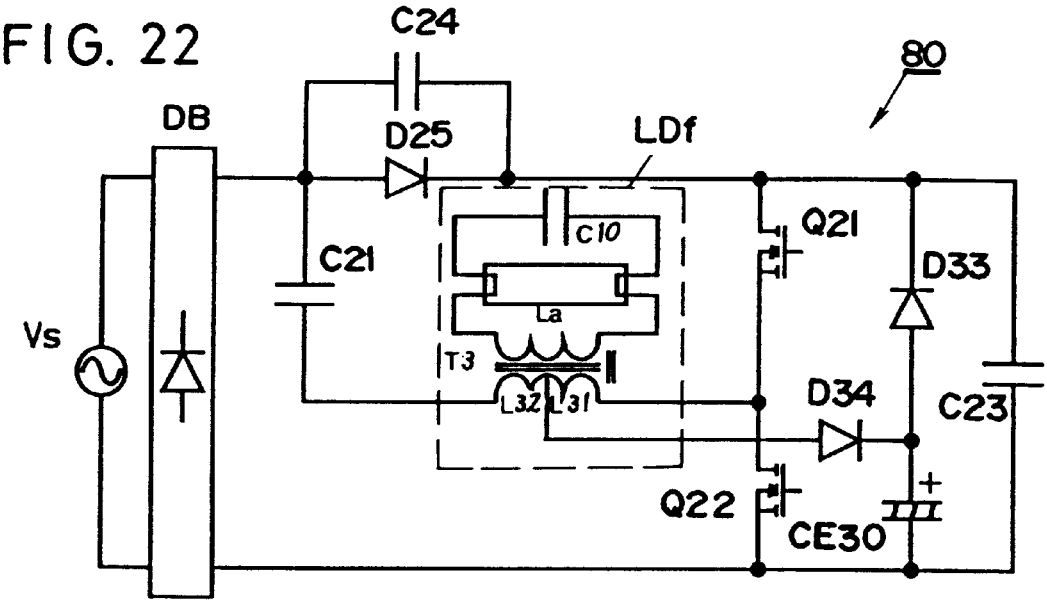
FIG. 22 is a circuit diagram showing thirteenth embodiment according to the present invention.

In a thirteenth embodiment shown in FIG. 22, a power source device 80 comprises a full-wave rectifier DB for full-wave rectifying an AC power from the AC poewr source Vs into a DC power, a diode D25 connected at the anode to the positive side output end of the full-wave rectifier DB, a pair of FET's Q21 and Q22 (as switching elements) connected in series across the output ends of the full-wave rectifier DB, that is, between the cathode of the diode D25 and the negative side output end of the rectifier DB, a capacitor C21 (first capacitor) connected at one end to the positive side output end of the rectifier DB, a load resonating circuit LDf connected between a junction point of the FET's Q21 and Q22 and the other end of the capacitor C21, a smoothing capacitor CE30 connected at its negative side terminal to the source of FET Q22, a diode D33 (discharging diode) connected between the drain of FET Q21 and the positive side terminal of the capacitor CE30 for causing a discharge current of the capacitor CE30 to flow therethrough, a diode D34 (charging diode) for causing a charge current to the capacitor CE30 to flow therethrough, a capacitor C23 connected in parallel with the capacitor CE30 and diode D33, and a capacitor C24 connected in parallel with the diode D25.

Referring more in detail to the power source 80 of the above arrangement, the load resonating circuit LDf comprises a discharge lamp La having a pair of filaments, a leakage transformer (hereinafter simply "transformer") T3 having a primary winding connected between a junction point of the FET's Q21 and Q22 and the other end of the capacitor C21 and a secondary winding connected in parallel with one end sides of both filaments of the discharge lamp La, and a capacitor C10 connected in parallel with the other end sides of both filaments of the discharge lamp La to constitute an LC resonance circuit together with an exciting inductance of the primary winding in the transformer T3. The primary winding has an intermediate tap, and is divided into two inductance elements such as an inductor L31 (first inductor) connected at an end to the junction point of FET's Q21 and Q22 and comprising part of the exciting inductance of the primary winding, and an inductor L32 (second inductor) connected in series with the first inductor L31 and comprising remainder part of the exciting inductance of the primary winding. The diode D34 is connected beween the positive side terminal of the smoothing capacitor CE30 and the other end of the first inductor L31.

Here, in the discharge lamp lighting device of FIG. 20, the smoothing capacitor CE20 is charged with a path of the full-wave rectifier DB, parallel circuit of the diode D25 and capacitor C24, capacitor CE20, diode D24, primary winding of the leakage transformer T2, FET Q22 and full-wave rectifier DB, and this path includes all exciting inductance of the primary winding in the transformer T2. To the contrary, in the power source device 80 of FIG. 22, the smoothing capacitor CE30 is charged with a path of the full-wave rectifier DB, parallel circuit of the diode D25 and capacitor C24, FET Q21, inductor L31, diode D34, capacitor CE30 and rectifier DB, and this path includes the inductor L31 as the exciting inductance forming part of the primary winding of the transformer T3 and, in this respect, the power source device 80 of FIG. 22 differs from the discharge lamp lighting device of FIG. 20.

Referring next generally to an example of setting sequence of respective values in the LC resonance circuit, first, with the priority given to the capacitive value of the capacitor C10, the capacitive value of the capacitor C10 and inductance values of the inductors L31 and L32 are decided, then, with the priority given to the inductance values of the inductors L31, the inductance values of the inductors L31 and L32 are decided, and the setting of the LC resonance circuit is executed in accordance with results of there decisions.

In such manner, it is made possible, also in the circuit arrangement shown in FIG. 22, to so set the capacitive value of the LC resonance circuit as to be able to apply a proper voltage to the discharge lamp La or to supply a proper current to the discharge lamp La, and to so set the inductance value of the LC resonance circuit as to be able to generate a proper smoothed voltage at the capacitor CE30. As a result, a circuit design rendering both of the input current distortion and crest factor of the output current to be proper is made possible.

Figure 23:
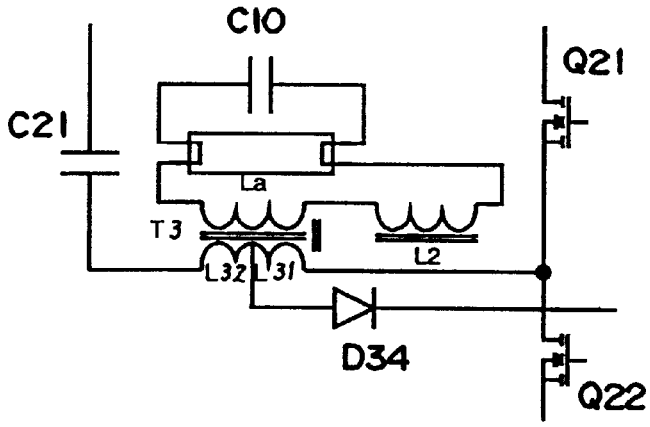
FIGS. 23 and 24 are explanatory diagrams for FIG. 22.

While in the thirteenth embodiment the inductor of the LC resonance circuit is constituted by the leakage inductor of the transformer T3, the arrangement may also be so made that, as shown in FIG. 23, another inductor L2 is connected in series with the secondary winding of the transformer T3. With this circuit arrangement, too, the generation at the capacitor CE30 of the properly smoothed voltage is possible, and the circuit design for renderring both the input current distortion and the crest factor of output current to be proper is possible. Further, when the arrangement is so made that, with the inductor having the intermediate tap employed, an end of one inductance element which this inductor has is connected to the junction point of FET's Q21 and Q22, it is enabled to attain the same effect even without using the leakage transformer.

Figure 24:
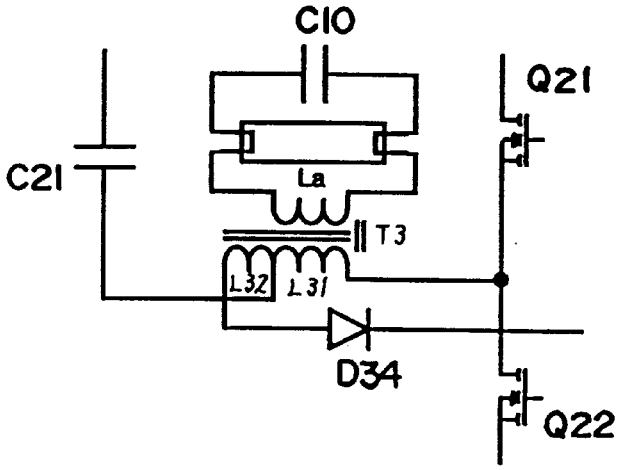

In the arrangement of the power source device 80 shown in FIG. 22, further, it is also possible, as shown in FIG. 24, to connect the capacitor C21 not to the inductor L32 but to the other end of the inductor L31 connected at one end to the junction point of the FET's Q21 and Q22, while the diode D34 is connected between the other end of the inductor L32 connected at one end to the other end of the inductor L31 and the positive side terminal of the smoothing capacitor CE30. In this arrangement, it is enabled to set the impedance of charging path for voltage dropping chopper to an optional value while satisfying its relationship to the inductance and capacitive values, and the circuit design for rendering both of the input current distortion and the crest factor of the output current to be proper is possible.

Fourteenth Embodiment

Figure 25:
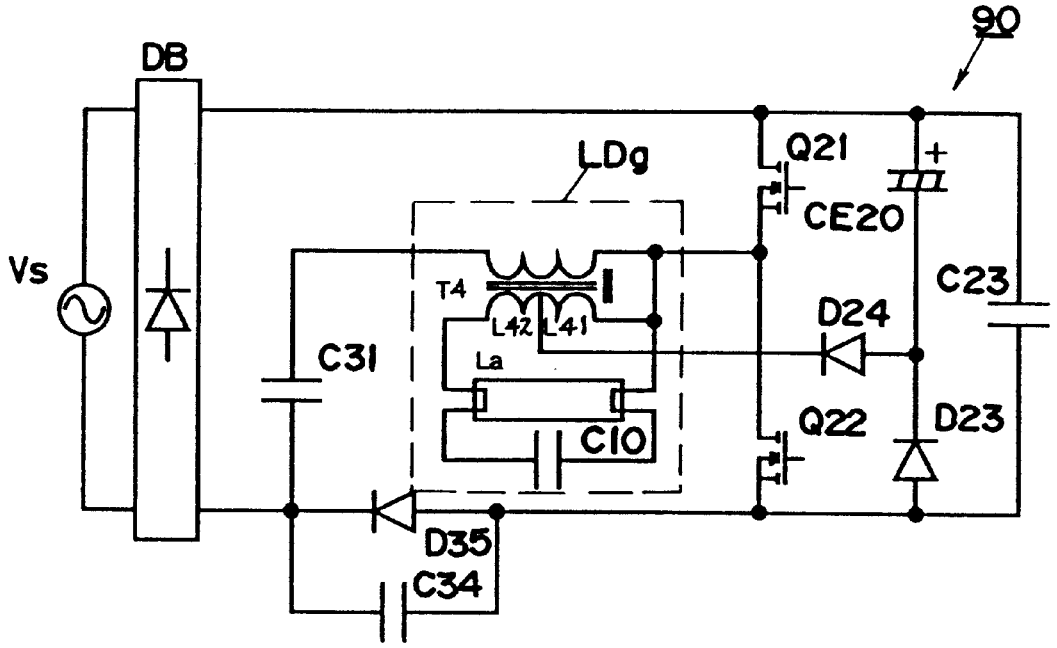
FIG. 25 is a circuit diagram showing fourteenth embodiment according to the present invention.

FIG. 25 is a diagram showing generally a circuit arrangement of the power source device according to a fourteenth embodiment, in which the power source device 90 comprises the full-wave rectifier DB, FET's Q21 and Q22, capacitors CE20, C23, C31 and C34 and diodes D23, D24 and D35 respectively arranged in the same manner as in the foregoing fourth embodiment, whereas a load resonance circuit LDg different from the fourth embodiment is provided.

This load resonance circuit LDg comprises the discharge lamp La having a pair of filaments, a leakage transformer (hereinafter simply "transformer") T4 having a primary winding connected between the junction point of FET's Q21 and Q22 and the other end of the capacitor C31 as well as a secondary winding connected in parallel with one end sides of both filaments of the discharge lamp La, and a capacitor C10 connected in parallel with the other end sides of both filaments of the lamp La, wherein the secondary winding of the transformer T4 has an intermediate tap and is divided into such two inductance elements as inductors L41 and L42, in which the inductor L41 (first inductor) is connected at an end to the junction point of FET's Q21 and Q22 and comprises part of exciting inductance of the second winding, and the inductor L42 (second inductor) is connected in series with the inductor L41 and comprises the remainder part of the exciting inductance of the secondary winding. Further, the diode D24 is connected between the negative side terminal of the capacitor CE20 and the other end of the inductor L41.

Here, in the power source device 80 of the thirteenth embodiment of FIG. 22, the smoothing capacitor CE30 is charged with the path of the full-wave rectifier DB, parallel circuit of diodes D25 and capacitor C24, FET Q21, inductor L31, diode D34, capacitor CE30 and rectifier DB, whereas, in the power source device 90 of the fourteenth embodiment of FIG. 25, the smoothing capacitor CE20 is charged with the path of the full-wave rectifier DB, capacitor CE20, diode D24, inductor L41, FET Q22, parallel circuit of the diode D35 and capacitor C34, and the power source device 90 is different from the power source device 80 in that the path includes the inductor L41 on the secondary winding of the transformer T4.

Referring next generally to an example of the setting sequence of the respective values of the LC resonance circuit, initially the priority is given to the capacitive value of the capacitor C10, and the capacitive value of the capacitor C10 and the inductance values of the inductors L41 and L42 are decided. Then, the priority is given to the inductance value of the inductor L41, and the inductance values of the inductor L41 and L42 are decided. The setting of the LC resonance circuit is decided in accordance with results of these decisions.

In this manner, it is possible even with the circuit arrangement of FIG. 25 to so set the capacitive values of the LC resonance circuit as to be able to apply to the discharge lamp La the proper voltage or the proper current, and to so set the inductance values of the LC resonance circuit as to be able to generate the proper smoothed voltage at the capacitor CE20. As a result, it becomes possible to design a circuit rendering both of the input current distortion and the crest factor of the output current to be proper.

Figure 26:
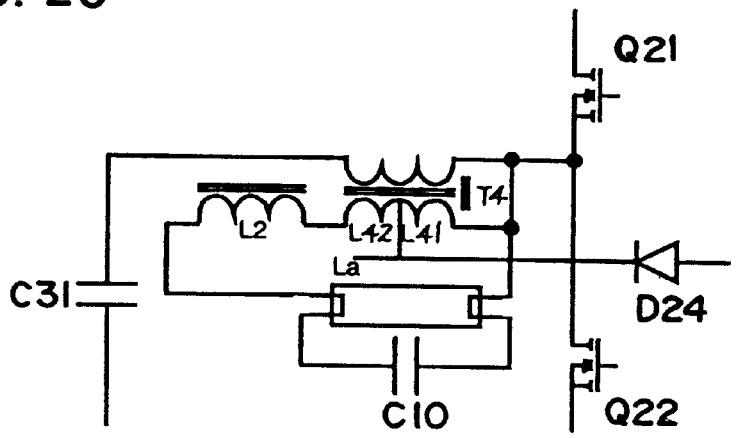
FIG. 26 is a circuit diagram showing a modification of the circuit in FIG. 25.

Further, while in the fourteenth embodiment the inductor of the LC resonance circuit comprises the leakage inductor of the leakage transformer T4, the arrangement may also be made by interposing, for example, another inductor L2 in the secondary winding of the transformer T4, as shown in FIG. 26. Even with this arrangement, it is possible to generate the proper smoothed voltage at the capacitor CE20 by properly setting the inductance value of the inductor L41, and to design the circuit which can render both of the input current distortion and the crest factor of the output current to be proper. Further, when the arrangement is so made that the inductor having an intermediate tap is employed and one of the inductance elements forming the inductor is connected at one end to the junction point of FET's Q21 and Q22, it is then possible to attain the same effect even without using the leakage transformer.

What is claimed is:

1. A discharge lamp lighting device, comprising:

a rectifier for rectifying an AC power source;

an inverter circuit including at least a switching element and converting a DC voltage into a high frequency voltage;

a smoothing capacitor;

a discharging diode inserted in a power supply path from the smoothing capacitor to the inverter circuit for passing therethrough a discharge current of the smoothing capacitor;

first impedance element inserted in a power supply path from DC output ends of the rectifier to the inverter circuit;

a series connection of a load circuit including a resonance circuit and a discharge lamp with second impedance element and inserted between an output end of the inverter circuit and the DC output ends of the rectifier; and a charging diode for allowing a charging current to flow to the smoothing capacitor through a path including the first impedance element, part of the load circuit and the switching element in ON period of the switching element;

wherein the second impedance element allows a DC current to pass through a path including the charging diode, load circuit and inverter circuit having the switching element.

2. The device according to claim 1 wherein the second impedance element includes an inductor.

3. The device according to claim 1 wherein the second impedance element includes a resistor.

4. The device according to claim 1 wherein the second impedance element includes a transformer.

5. The device according to claim 1 wherein the second impedance element includes a transformer and an inductor.

6. The device according to claim 1 wherein the second impedance element constitutes the resonance circuit included in the load circuit.

7. The device according to claim 2 wherein the inductor constitutes the resonance circuit included in the load circuit.

8. The device according to claim 5 wherein the inductor constitutes the resonance circuit included in the load circuit.

9. The device according to claim 4 wherein the transformer constitutes the resonance circuit included in the load circuit.

10. The device according to claim 5 wherein the transformer constitutes the resonance circuit included in the load circuit.

11. The device according to claim 1 wherein a coupling capacitor is connected between a junction point of one of the output ends of the rectifier with the first impedance element and the charging diode.

12. The device according to claim 1 wherein the first impedance element includes a diode connected in a polarity allowing the charging current to the smoothing capacitor to pass therethrough and a capacitor connected in parallel with said diode.

13. The device according to claim 1 wherein the first impedance element includes an inductor.

14. The device according to claim 11 wherein a diode is connected across the coupling capacitor.

15. The device according to claim 1 wherein the inverter circuit comprises a series circuit of two switching elements alternately turned ON and OFF at a high frequency.

16. The device according to claim 1 wherein the inverter circuit includes a series circuit of a switching element turned ON and OFF at a high frequency and an inductor.

17. The device according to claim 1 wherein the current flows through a path including the charging diode, the inductance and the switching element of the inverter circuit upon ON operation of the switching element.

18. The device according to claim 1 wherein the first impedance element is partly connected across the DC output ends of the rectifier.

19. The device according to claim 4 wherein the transformer has a terminal, and the charging diode is connected through the terminal.

20. The device according to claim 5 wherein the transformer has a terminal, and the charging diode is connected through the terminal.

21. A discharge lamp lighting device, comprising:

a rectifier for rectifying an AC power source;

an inverter circuit including at least a switching element and converting a DC voltage into a high frequency voltage;

a smoothing capacitor;

a discharging diode inserted in a power supply path from the smoothing capacitor to the inverter circuit for passing threrethrough a discharge current of the smoothing capacitor;

first impedance element inserted in a power supply path from the DC output ends of the rectifier to the inverter circuit;

a series connection of a load circuit and second impedance element, said load circuit including a transformer having a primary winding inserted between one of the output ends of the inverter circuit and a DC output end of the rectifier and a secondary winding to which a discharge lamp is connected, and a resonance circuit; and a charging diode for allowing a charging current to flow to the smoothing capacitor through a path including the first impedance element, part of the load circuit and the switching element in ON period of the switching element forming the inverter circuit;

wherein the second impedance element is provided for allowing a DC current to pass through a path including the charging diode, second impedance element, load circuit and switching element.

22. The device according to claim 21 wherein the transformer has a terminal, and the charging diode is connected through the terminal.

* * * * *